US010954044B2

(12) United States Patent
Perdue et al.

(10) Patent No.: US 10,954,044 B2
(45) Date of Patent: Mar. 23, 2021

(54) CONTAINER HAVING CHILD-RESISTANT SENIOR-FRIENDLY FEATURES AND METHOD OF USING AND MAKING SAME

(71) Applicant: CSP Technologies, Inc., Auburn, AL (US)

(72) Inventors: Ethan Ross Perdue, Auburn, AL (US); G. F. Alexia Gleason, Madison, WI (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 0 days.

(21) Appl. No.: 16/611,101

(22) PCT Filed: May 4, 2018

(86) PCT No.: PCT/US2018/031104
§ 371 (c)(1),
(2) Date: Nov. 5, 2019

(87) PCT Pub. No.: WO2018/204794
PCT Pub. Date: Nov. 8, 2018

(65) Prior Publication Data

US 2020/0156832 A1 May 21, 2020

Related U.S. Application Data

(60) Provisional application No. 62/532,403, filed on Jul. 14, 2017, provisional application No. 62/501,899, filed on May 5, 2017.

(51) Int. Cl.
*B65D 50/04* (2006.01)
*B65D 43/16* (2006.01)

(52) U.S. Cl.
CPC ..... *B65D 50/046* (2013.01); *B65D 43/16* (2013.01); *B65D 2215/02* (2013.01)

(58) Field of Classification Search
CPC .... B65D 43/16; B65D 43/021; B65D 50/046; B65D 43/22; B65D 2215/02; B65D 2215/06; A45C 13/1084
See application file for complete search history.

(56) References Cited

U.S. PATENT DOCUMENTS 4,964,661 A * 10/1990 Cadwell ..... E05C 19/06 292/337
2002/0185404 A1 12/2002 Donegan
(Continued)

FOREIGN PATENT DOCUMENTS

WO 201411284 A1 7/2014

OTHER PUBLICATIONS

International Search Report for PCT/US2018/031104, dated Sep. 3, 2018.

*Primary Examiner* — Andrew T Kirsch
(74) *Attorney, Agent, or Firm* — Mark T. Vogelbacker; Eckert Seamans Cherin & Mellott, LLC

(57) ABSTRACT

A container (600) includes a base (650) having a floor portion (651) and an outer wall (652) extending upwardly therefrom. A lid (600) includes a ceiling portion (611) and an outer wall (612) extending downwardly therefrom, the lid being movable with respect to the base between a closed position and an open position. In the closed position the combined lid and base define a cavity configured to enclose product. One of the base and the lid includes a first maintaining tab (656) extending upwardly from the floor portion or downwardly from the ceiling portion. The first maintaining tab being positioned inwardly of the outer wall of the one of the base and the lid. The other one of the base and the lid including a first opening (622) extending there through. At least a portion of the first maintaining tab extending through the first opening to maintaining the lid in the closed position.

25 Claims, 35 Drawing Sheets

(56) References Cited

U.S. PATENT DOCUMENTS

| | | | | |
|---|---|---|---|---|
| 2004/0226853 | A1 | 11/2004 | Intini | |
| 2009/0127156 | A1* | 5/2009 | Tung | B65D 83/0463 206/531 |
| 2015/0315532 | A1 | 11/2015 | Bergbohm et al. | |
| 2017/0137184 | A1 | 5/2017 | Burek et al. | |

* cited by examiner

CONTAINER HAVING CHILD-RESISTANT SENIOR-FRIENDLY FEATURES AND METHOD OF USING AND MAKING SAME

CROSS-REFERENCE TO RELATED APPLICATIONS

This application is a U.S. National Phase of International Application No. PCT/US2018/031104 filed May 4, 2018, which claims priority to U.S. Provisional Patent Application Nos. 62/501,899 filed May 5, 2017 and 62/532,403 filed Jul. 14, 2017, which are incorporated herein by reference in their entireties.

BACKGROUND

There is a need to protect children from inadvertently gaining access to medications and other potentially harmful products. Ingestion of only one or two pills of a prescribed medication can prove fatal to a child. There is also a need to provide containers that are readily and easily opened by an adult, that is, any person having the cognitive ability to understand the instructions for opening a container, which requires certain manipulation and manual dexterity. Such persons are assumed to have the ability to understand that the act of opening such a container to gain access to the contents is a deliberate action, and is only undertaken when there is a necessity to attain access to such contents. There is also a need to create such a container that is relatively small, so as to hold a sufficient amount of product while being configured to easily fit within a small space (e.g., a user's pant pocket).

There are several conventional childproof or child-resistant containers in the market, which are generally employed by dispensing pharmacists for use in filling prescriptions, where the prescription requires that the pharmacist dispense one or more of a plurality of pills, tablets, gel-caps, capsules, or the like. For example, the container may include a push-and-turn closure for pill containers, or an arrow-alignment closure for pill containers.

The push-and-turn system for containers conventionally refers to system in which the closure or cap for the container must be pushed axially downwardly and rotated at the same time to open the container. The arrow alignment system for containers conventionally refers to a system in which an arrow on the closure or cap must be aligned with an arrow on the container, such as one which is embossed on the container, to open the container. However, these containers are often difficult for adults to use, especially the elderly or individuals with physical disabilities or arthritis.

Another type of prior art container is shown and described in U.S. Patent Publication No. 2017/0137184 (Burek), which discloses side-pinch and front push-down features.

SUMMARY

The presently disclosed technology covers a variety of designs and configurations. For example, one design includes a container that is opened by pressing in on the front of the container, while simultaneously forcing the opening of the two halves (e.g., lid and base) of the container based upon an arrow indicator. Such action unlocks a pair of hooks that is used to keep the container locked or closed. Another design includes a container with two recessed areas that are located on the bottom of the container. These recessed areas allows a user's fingers to pinch a locking mechanism. The user is able to open the container by pinching the bottom of the container while simultaneously opening the container from the front. A further design includes a container configured such that a user pushes a section of the container, which also acts as a locking feature. By pushing on the locking feature, the feature clears the part of the container offering resistance, thereby allow the user to open the container.

In one embodiment, the presently disclosed technology is directed to a container including a base having a floor portion and an outer wall extending upwardly therefrom. A lid includes a ceiling portion and an outer wall extending downwardly therefrom, the lid being movable with respect to the base between a closed position and an open position. In the closed position the combined lid and base define a cavity configured to enclose product. One of the base and the lid includes a first maintaining tab extending upwardly from the floor portion or downwardly from the ceiling portion. The first maintaining tab being positioned inwardly of the outer wall of the one of the base and the lid. The other one of the base and the lid including a first opening extending therethrough. At least a portion of the first maintaining tab extending through the first opening to maintaining the lid in the closed position.

In another embodiment, the presently disclosed technology is directed to a method of opening a container. The container including a base having a floor portion and an outer wall extending upwardly therefrom. The container further including a lid having a ceiling portion and an outer wall extending downwardly therefrom. A first button extends outwardly through the outer wall of the base. A second button extends outwardly through the outer wall of the lid. The method includes pressing the first button inwardly toward a center of the container, pressing the second button inwardly toward the center of the container, and pivoting the lid with respect to the base to expose a cavity configured to contain product.

In yet another embodiment, the presently disclosed technology is directed to a container including a base having a floor portion and an outer wall extending upwardly therefrom. A first maintaining tab extends upwardly from the floor portion. The first maintaining tab is optionally positioned inwardly of the outer wall of the base portion. An opening extends through the base. A lid includes a ceiling portion and an outer wall extending downwardly therefrom. A second maintaining tab extends downwardly from the ceiling portion. The second maintaining tab is optionally positioned inwardly of the outer wall of the lid. An opening extends through the lid. A hinge is pivotally attached the lid to the base. The lid is movable with respect to the base between a closed position and an open position. In the closed position the combined lid and base define a cavity configured to enclose product. At least a portion of the first maintaining tab extends through the opening of the lid when the lid is in the closed position. At least a portion of the second maintaining tab extends through the opening of the base when the lid is in the closed position.

In still a further embodiment, the presently disclosed technology is directed to a method of opening a container. The container including a base having a floor portion, an outer wall extending upwardly from the floor portion, and a first tab extending upwardly from the floor portion. The container further including a lid having a ceiling portion, an outer wall extending downwardly from the floor portion, and a second tab extending downwardly from the floor portion. The method includes pressing the first tab inwardly toward a center of the container to disengage the first tab from the ceiling portion of the lid, pressing the second tab inwardly toward the center of the container to disengage the second tab from the floor portion of the base, and pivoting the lid with respect to the base to expose a cavity configured to contain product.

BRIEF DESCRIPTION OF THE DRAWINGS

The foregoing summary, as well as the following detailed description of the presently disclosed technology, will be better understood when read in conjunction with the appended drawings, wherein like numerals designate like elements throughout. To illustrate the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

Figure 1:
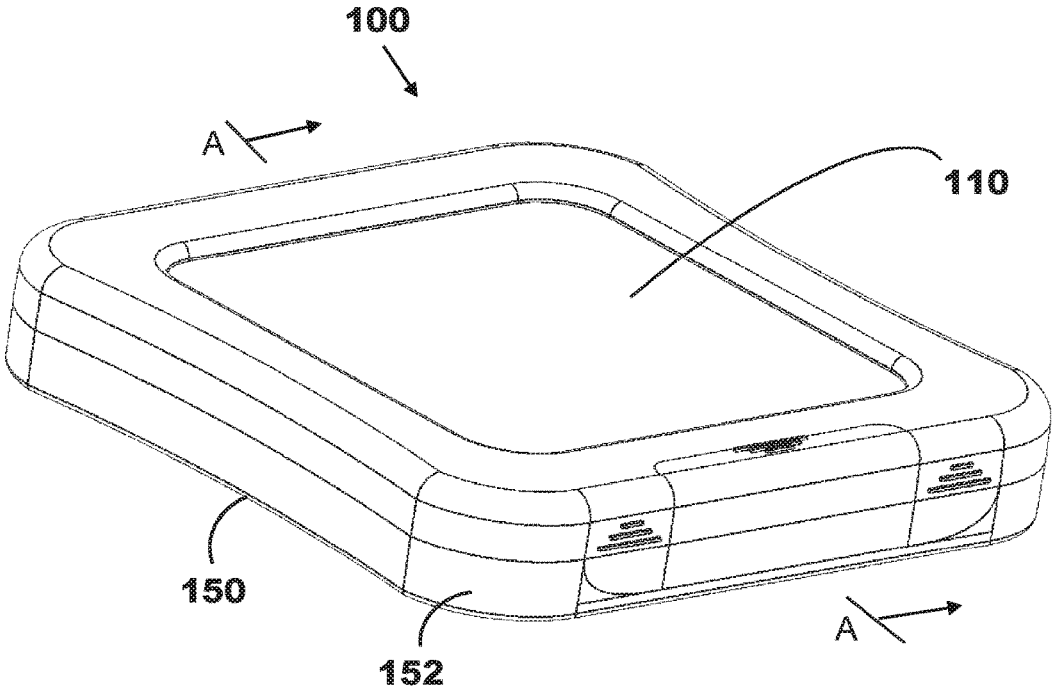
FIG. 1 is a perspective view of a container of an embodiment of the presently disclosed technology, wherein the container is shown in a first or closed configuration.

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

For purposes of the description hereinafter, directional phrases used herein, such as, "left," "right," "up," "down," "top," "bottom," and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." The terminology includes the words noted above, derivatives thereof and words of similar import.

A first embodiment of a container 100 according to the disclosed concept is shown in FIGS. 1-7. Container 100 includes a lid 110 and a base 150. Lid 110 and base 150 are optionally connected by a hinge (see, for example, hinge 190, shown in FIG. 5). Optionally, this configuration results in a clamshell-like structure, for example where a length and a width of the container are generally equal, and both are significantly greater than a height of the container. This design features a narrow space for product containment, such that small, thin or narrow product can be enclosed therein. Such products are often difficult to package in a child-resistant form. In accordance with the disclosed concept, container 100 further includes a child-resistant, senior-friendly means, which makes it difficult for a child to open container 100, but relatively easy for an adult to open container 100.

Figure 2:
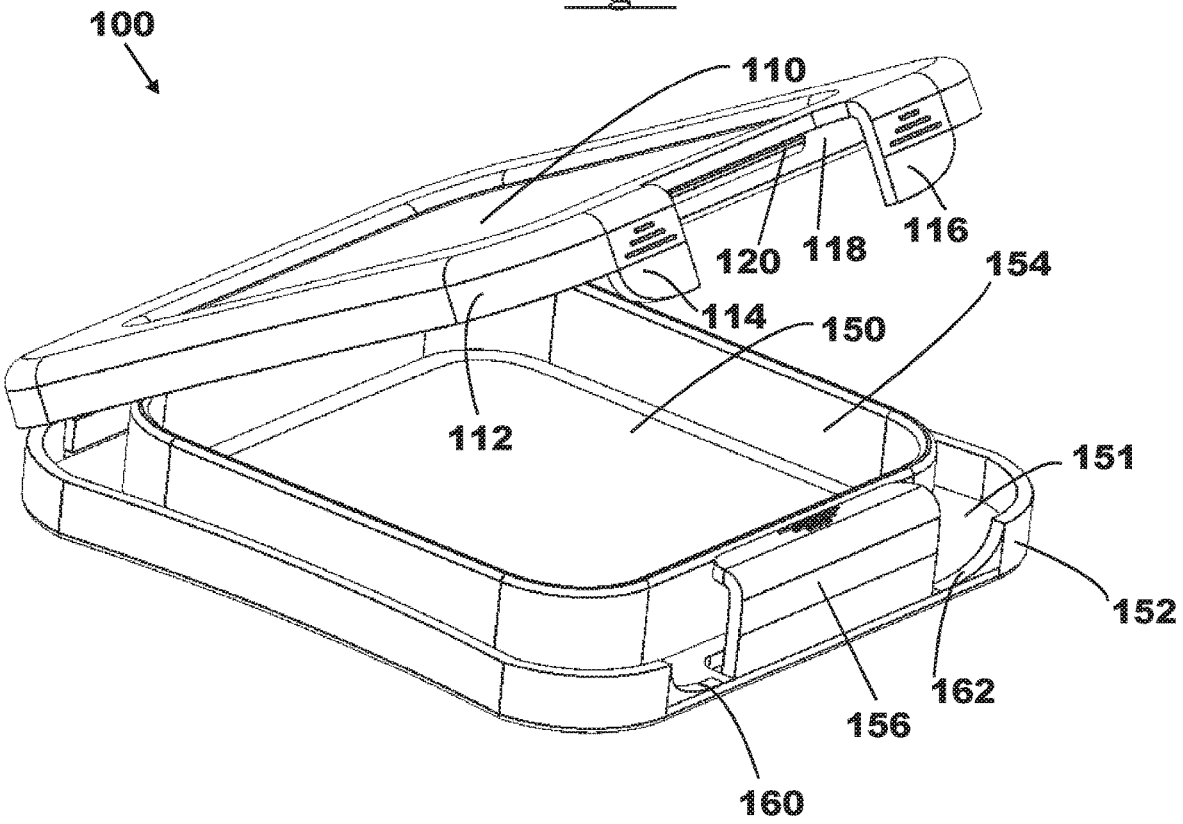
FIG. 2 is another perspective view of the container of FIG. 1, wherein the container shown in a second or open configuration.
Figure 3:
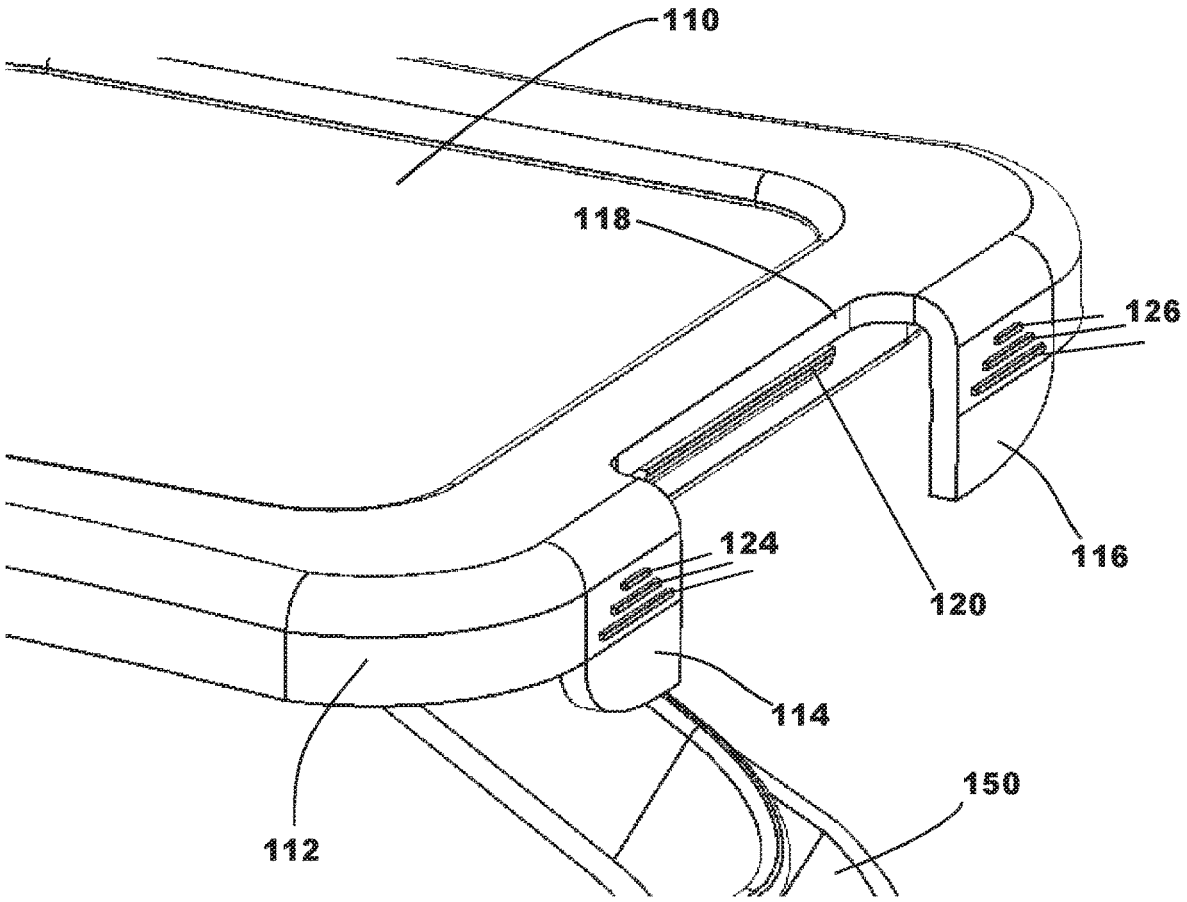
FIG. 3 is a magnified view of a portion of the container of FIG. 2.
Figure 4:
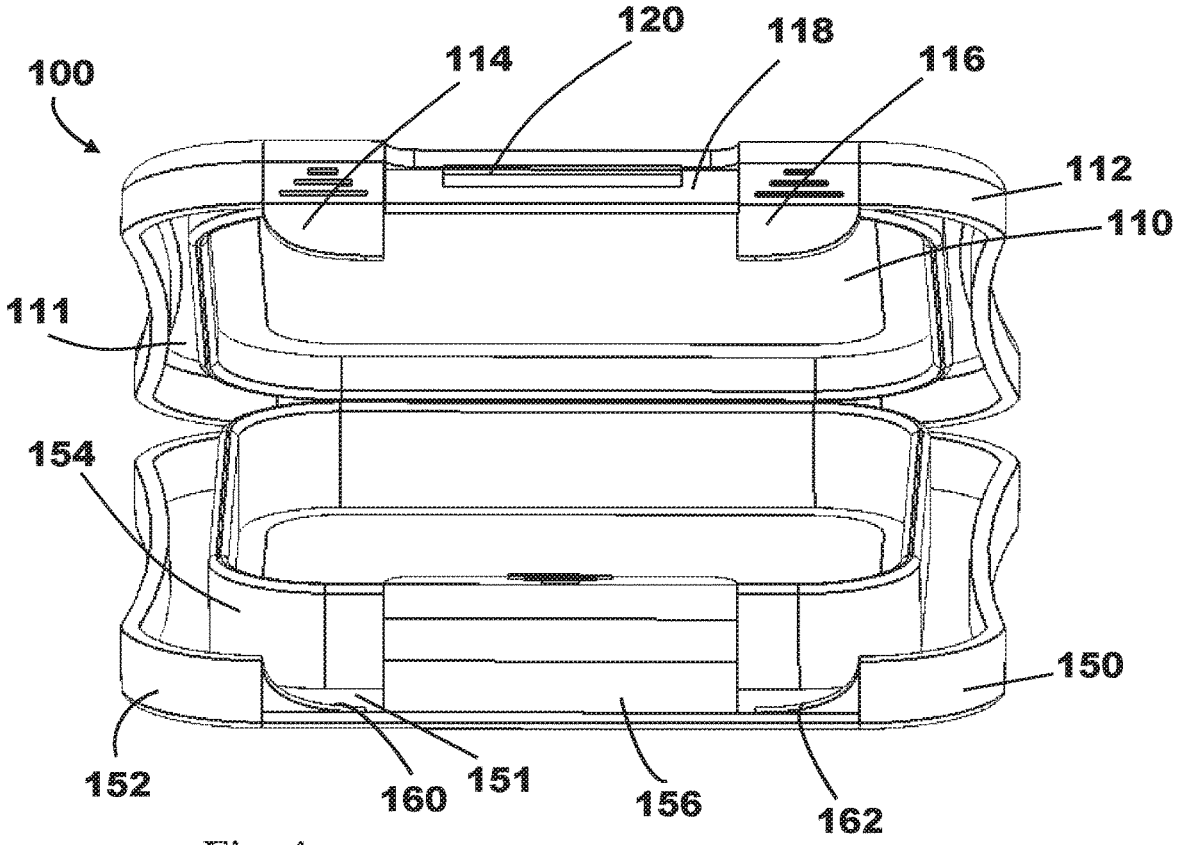
FIG. 4 is yet another perspective view of the container of FIG. 2.
Figure 5:
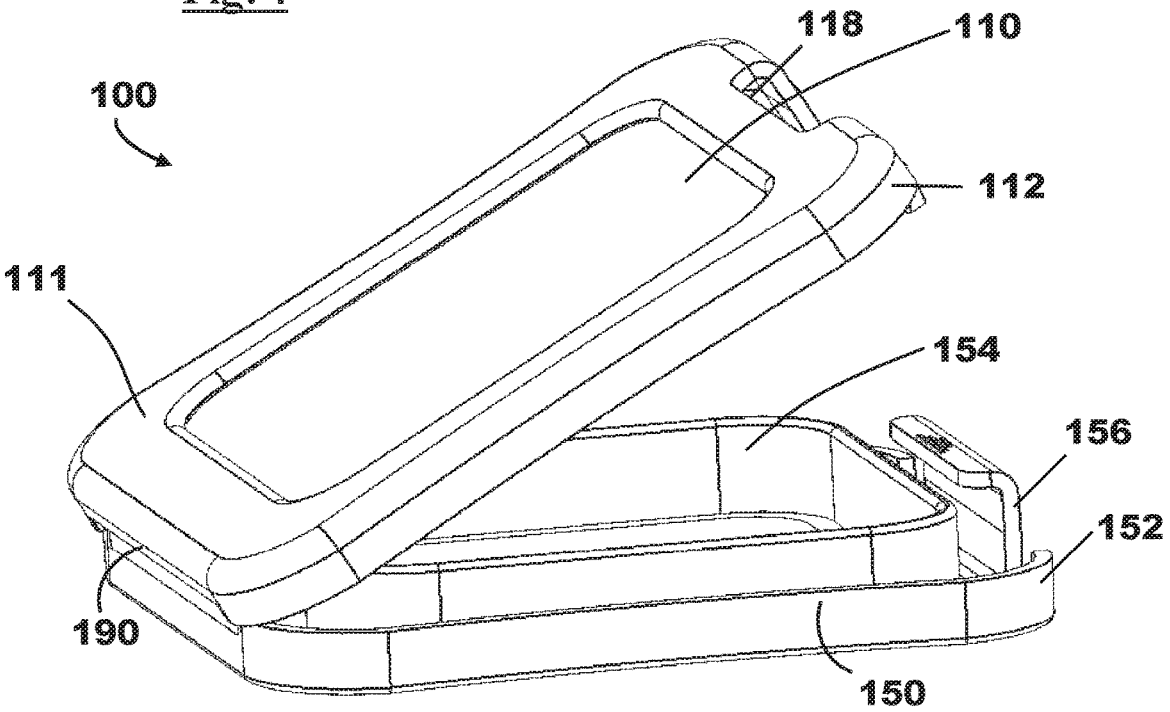
FIG. 5 is still another perspective view of the container of FIG. 2.

More specifically, and with reference to FIG. 2, base 150 has a floor portion 151, an outer wall 152 extending from floor portion 151, and an inner wall 154 extending from floor portion 151. The entire inner wall can be spaced inwardly from the outer wall 152. Furthermore, base 150 has latching portion, latching mechanism, or retention member 156 extending upwardly from floor portion 151. In one embodiment, latching mechanism is spaced outwardly from inner wall 154.

As shown in FIG. 2, outer wall 152 terminates at or includes end portions 160, 162 that are located on opposing sides of latching portion 156. Each end portion 160, 162 can be sized, shaped and/or configured to complementarily receive one of the teeth 114, 116 when the lid 110 is in the closed position. For example, each end portion 160, 162 can be in the shape of a cut-out. In this manner, and as will be discussed below, latching portion 156 is able to pivot about floor portion 151. Optionally, latch portion 156 is positioned opposite hinge 190, which can be a living hinge.

Lid 110 has a ceiling portion 111, an outer wall 112 that extends nearly entirely around a periphery thereof, and at least two spaced-apart teeth 114, 116 extending downwardly from outer wall 112 and/or ceiling portion 111. Outer wall 112 has a grooved region 118 positioned between the teeth 114, 116, and lid 110 further has an elongated protrusion 120 extending outwardly from grooved region 118.

Figure 6:
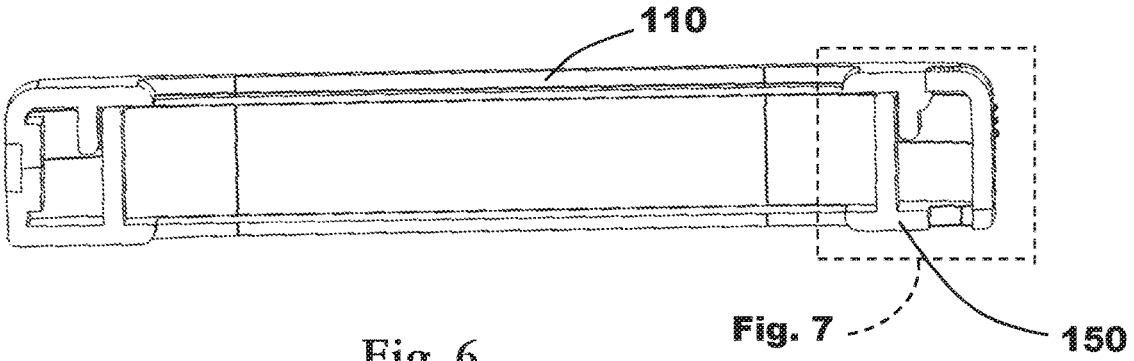
FIG. 6 is a cross-sectional elevation view of the container taken along line A-A of FIG. 1.
Figure 7:
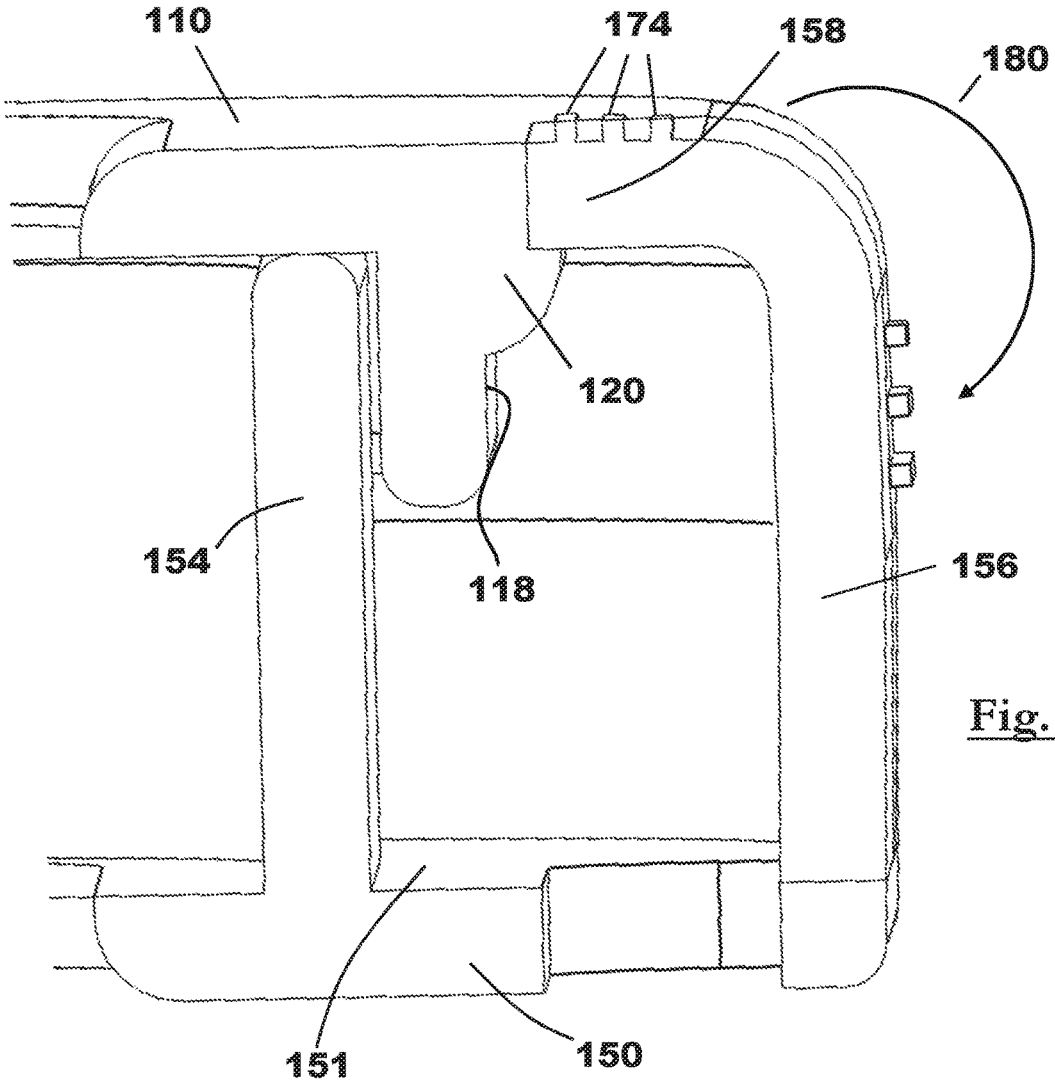
FIG. 7 is a magnified view of a portion of the container of FIG. 6.
Figure 8:
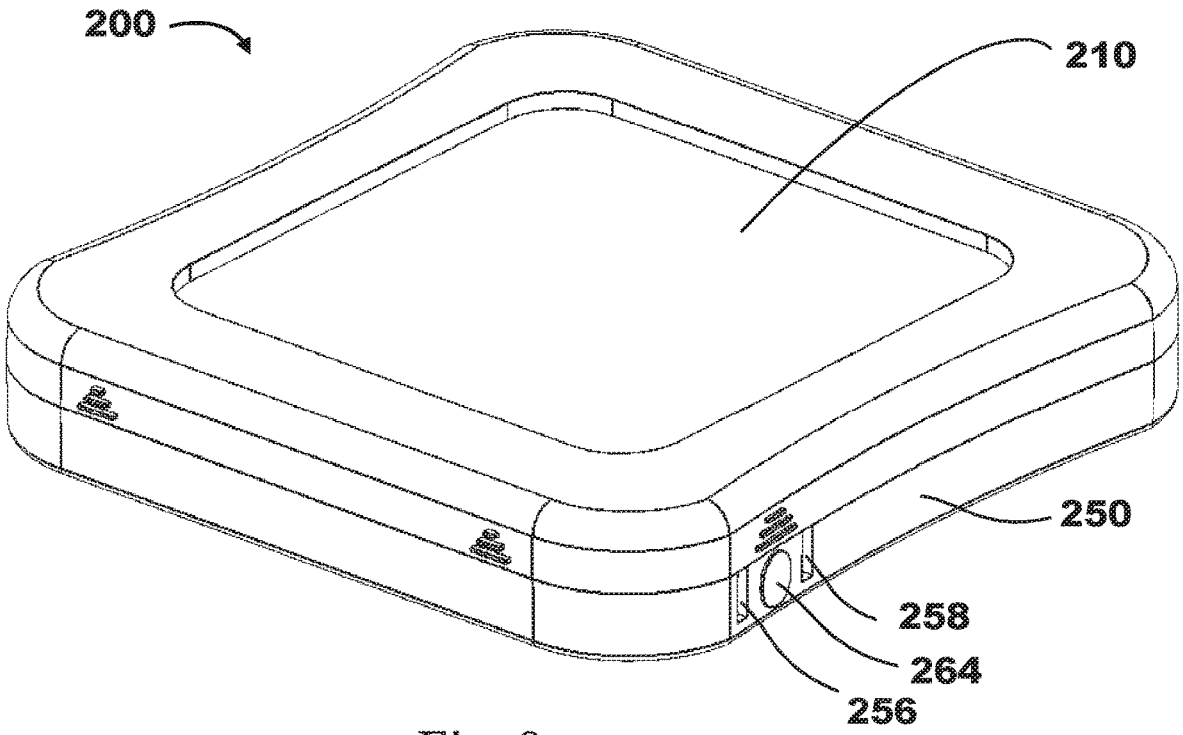
FIG. 8 is a perspective view of a container of an embodiment of the presently disclosed technology, wherein the container is shown in a first or closed configuration.
Figure 9:
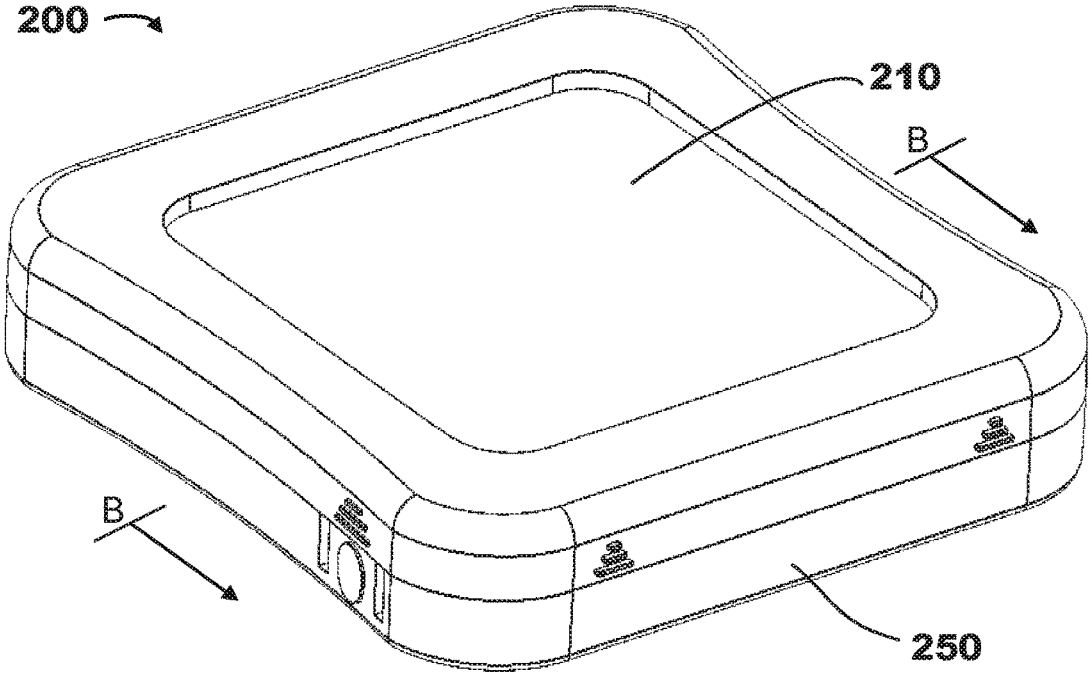
FIG. 9 is another perspective view of the container of FIG. 8.

Interaction between protrusion 120 (and/or another portion of lid 110) and latching portion 156 provides container 100 with child-resistant means or a child-resistant senior-friendly feature. More specifically, as shown in FIGS. 6 and 7, when container 100 is in the closed position (i.e., product (s), such as pills, tablets, and the like, are enclosed within a cavity thereof), a distal portion 158 of latching portion 156 engages and rests on top of protrusion 120 (and/or another portion of lid 110). In this manner, lid 110 is prevented from moving to the open position, because of the presence of or obstruction caused by the latching portion 156, unless a specific motion or operation is completed. That is, distal portion 158 of latching portion 156 blocks lid 110 from moving away from base 150 and/or maintains container 100 in the closed position. Optionally, a proximal portion of the latching portion 156 is integrally or unitarily formed with the base 150.

In one aspect, latching portion 156 is structured, located and/or configured to be moved or pivoted in a direction 180 such as, for example, by an adult pulling distal portion 158 away from lid 110. When latching portion 156 is moved a sufficient distance in the direction 180, any interference between latching portion 156 and protrusion 120 of lid 110 is removed. A user is then able to open the lid 110. More particularly, in one example, a user is then free to grip teeth 114, 116 (i.e., by suitable respective gripping portions 124, 126 (see FIG. 3) of teeth 114, 116) and rotate lid 110 to the open position. However, the user is not required to grip teeth 114, 116 to open the lid 110 at this point in the operation, as several other portions of lid 110 (or body 150) can be contacted to open container 100.

Optionally, as shown in FIG. 7, latching portion 156 includes a plurality of spaced-apart gripping portions 174 that function to allow a user to have a more secure grip on latching portion 156 when moving latching portion 156 in the direction 180 to move container 100 to the open position (FIGS. 2-5), or in any other direction.

Thus, container 100 has a mechanism by which a user must perform two different steps to move container 100 from the closed position to the open position. First, the user must pull latching portion 156 in direction 180, or in a direction that disengages latch portion from lid 110. Second, once there is no longer any interference between distal portion 158 and protrusion 120 or any other portion of lid 110, the user can simply open lid 110 vis-à-vis teeth 114, 116 or by pivoting the lid 110 with respect to the base 150.

The present embodiment is not limited to the exact configuration shown and described herein. For example, in a modified aspect, latching portion 156 extends downwardly from ceiling portion 111 of lid 110, and teeth 114, 116 extend upwardly from floor portion 151 of base 150.

A second embodiment of a container 200 according to the disclosed concept is shown in FIGS. 8-15. Similar or identical structure between the embodiment of FIGS. 1-7 and the embodiment of FIGS. 8-15 is distinguished in FIGS. 8-15 by a reference number with a magnitude one hundred (100) greater than that of FIGS. 1-7. Description of certain similarities between the embodiment of FIGS. 1-7 and the embodiment of FIGS. 8-15 may be omitted herein for convenience and brevity only.

Container 200 includes a lid 210 and a base 250 optionally connected to lid 210 by a hinge, such as a living hinge. In accordance with the disclosed concept, container 200 further includes a novel child-resistant, senior-friendly feature.

Figure 10:
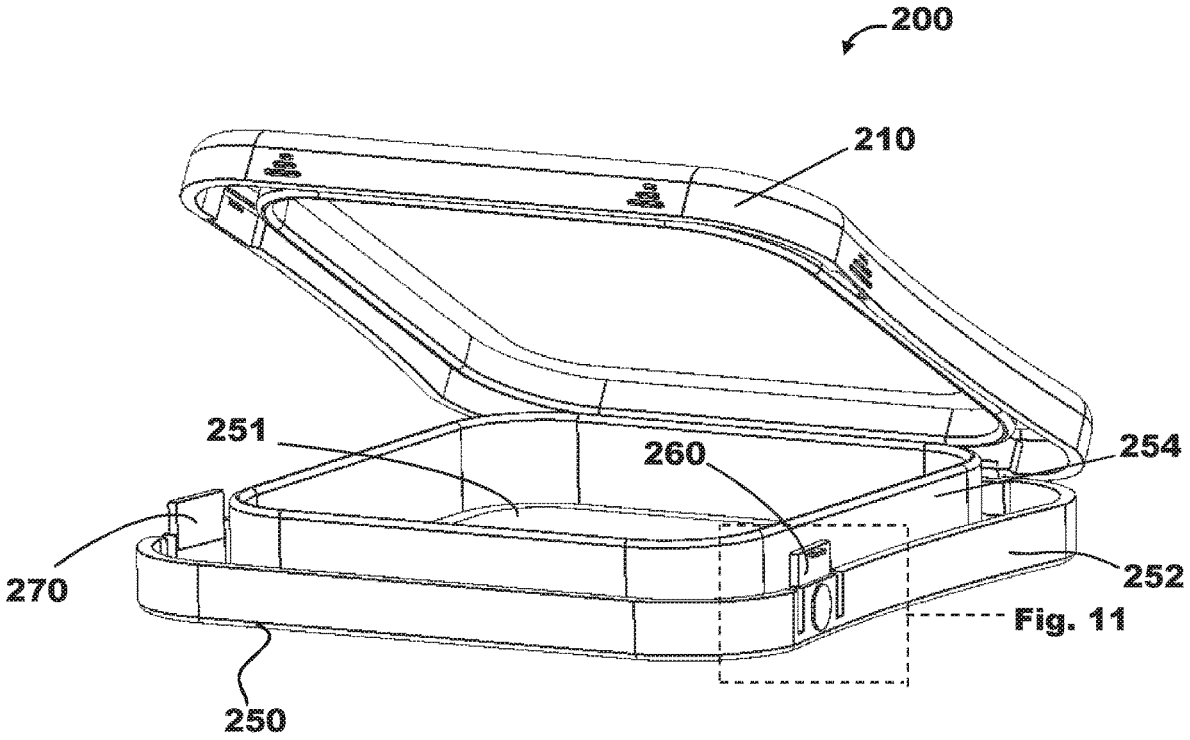
FIG. 10 is a yet another perspective view of the container of FIG. 8, wherein the container shown in a second or open configuration.
Figure 11:
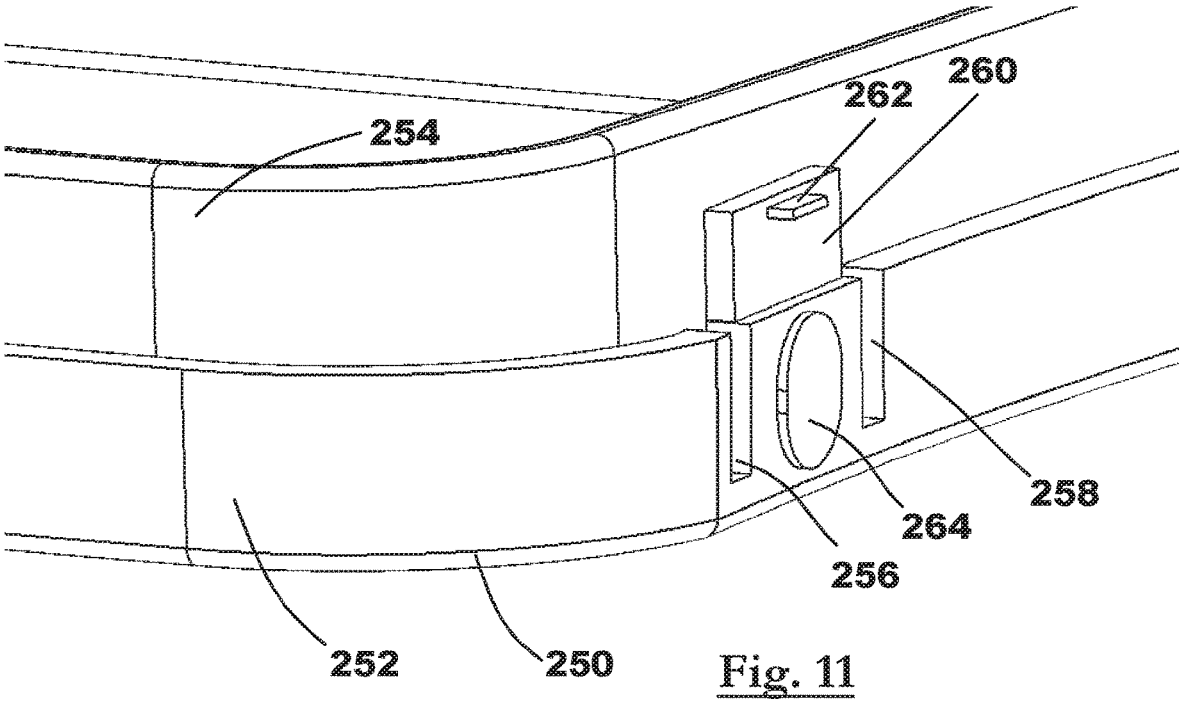
FIG. 11 is a magnified view of a portion of the container of FIG. 10.

More specifically, as shown in FIG. 10, base 250 includes a floor portion 251, an outer wall 252 extending outwardly from floor portion 251, and inner wall 254 extending outwardly from floor portion 251. Referring to FIG. 11, outer wall 252 includes at least one, two or a plurality of grooved regions 256, 258. Located between, above, or extending between each of grooved regions 256, 258 is a retention member or latching mechanism 260. Optionally, retention member 260 has at least one protrusion 262 extending outwardly therefrom, and at least one button mechanism 264 extending outwardly therefrom. The protrusion 262 can be located above the button mechanism 264. Retention member 260 is able to deflect inwardly toward inner wall 254 (i.e., responsive to being pressed by a user). More particularly, a lower end of retention member 260 can be integrally formed with base 250, such as floor portion 251 thereof. An upper end of retention member 260 can be free or not connected to any structure.

Figure 12:
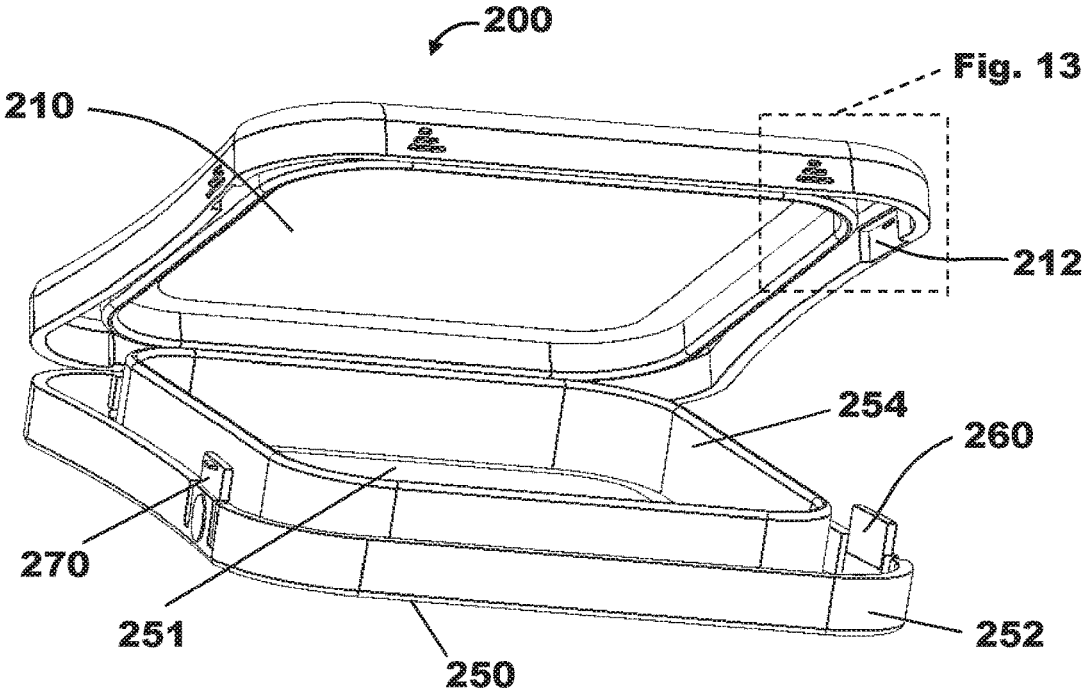
FIG. 12 is still another perspective view of the container of FIG. 10.
Figure 13:
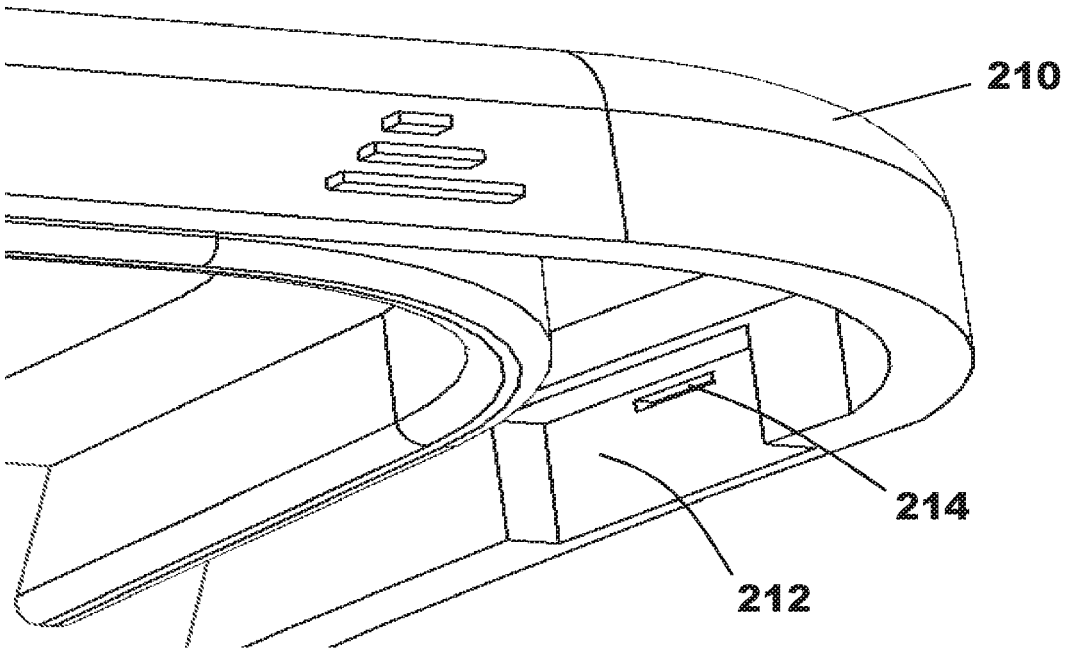
FIG. 13 is a magnified view of a portion of the container of FIG. 12.
Figure 14:
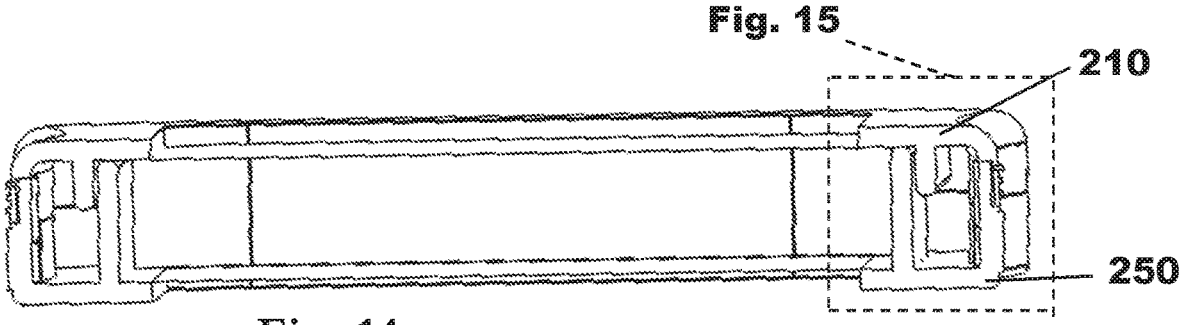
FIG. 14 is a cross-sectional elevation view of the container taken along line B-B of FIG. 9.

Referring to FIGS. 12 and 13, lid 210 includes at least one, two, or a plurality of pocket portions 212, and at least one groove 214 positioned therein or extending therethrough. For ease of illustration and economy of disclosure, only retention member 260 and groove 214 are being discussed herein. It will, however, be appreciated that a corresponding opposing retention member 270 of base 250 and a corresponding opposing groove of lid 210 interact in the same manner as retention member 260 and groove 214.

Interaction between protrusion 262 and groove 214 provide container 200 with a child-resistant, senior-friendly feature. More specifically, and with reference to FIGS. 14 and 15, which are section views taken along line B-B of FIG. 9, protrusion 262 extends at least partially through groove 214 when container 200 is in the closed position. In one example embodiment, protrusion 262 extends entirely through groove 214. This interaction prevents lid 210 from being opened by a typical opening motion (i.e., one that could simply be performed by a child). That is, as shown, if lid 210 were attempted to be opened in the position depicted in FIG. 15, the interference of protrusion 262 with groove 214 would prevent lid 210 from being opened.

Figure 15:
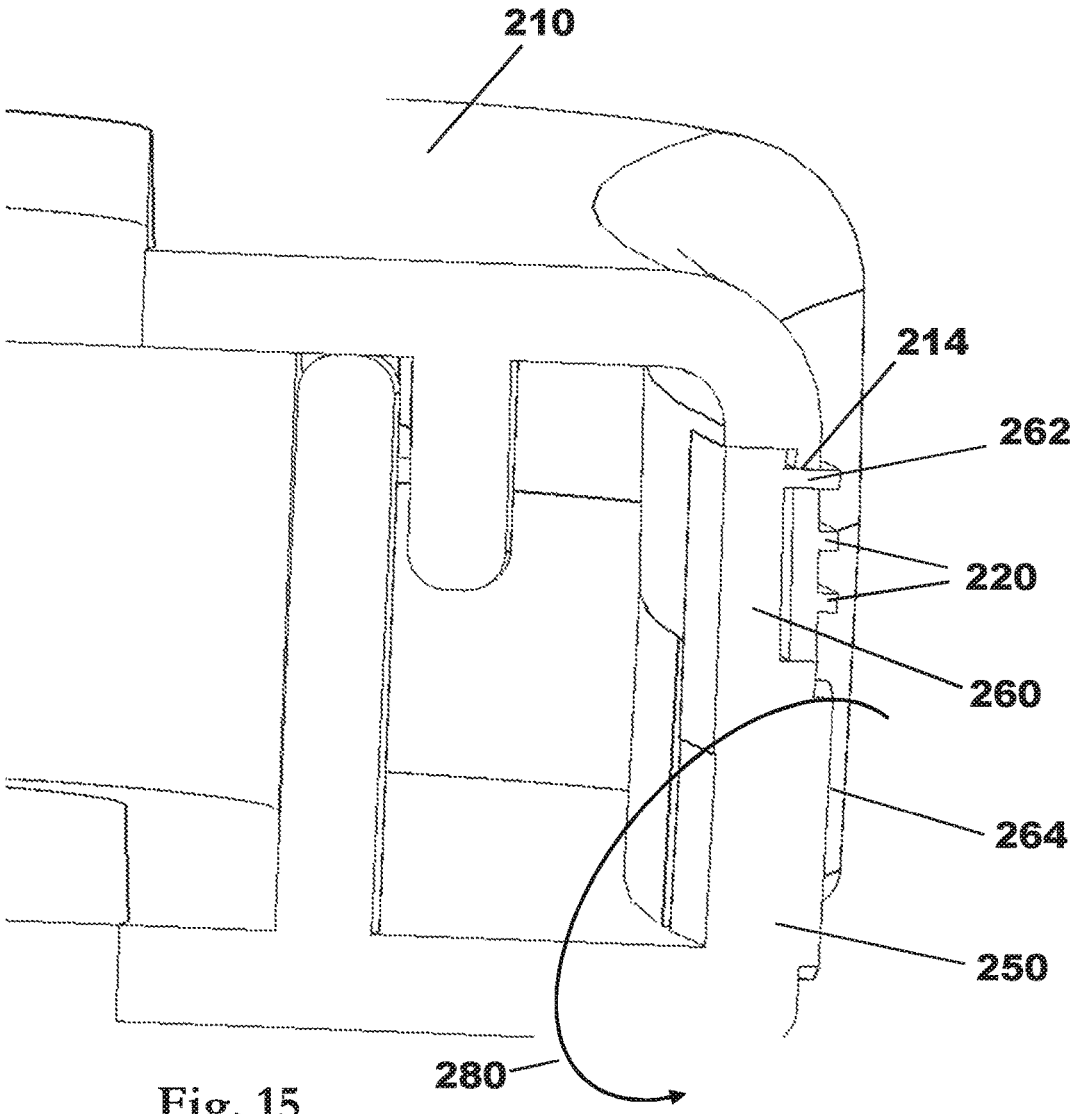
FIG. 15 is a magnified view of a portion of the container shown in FIG. 14.
Figure 16:
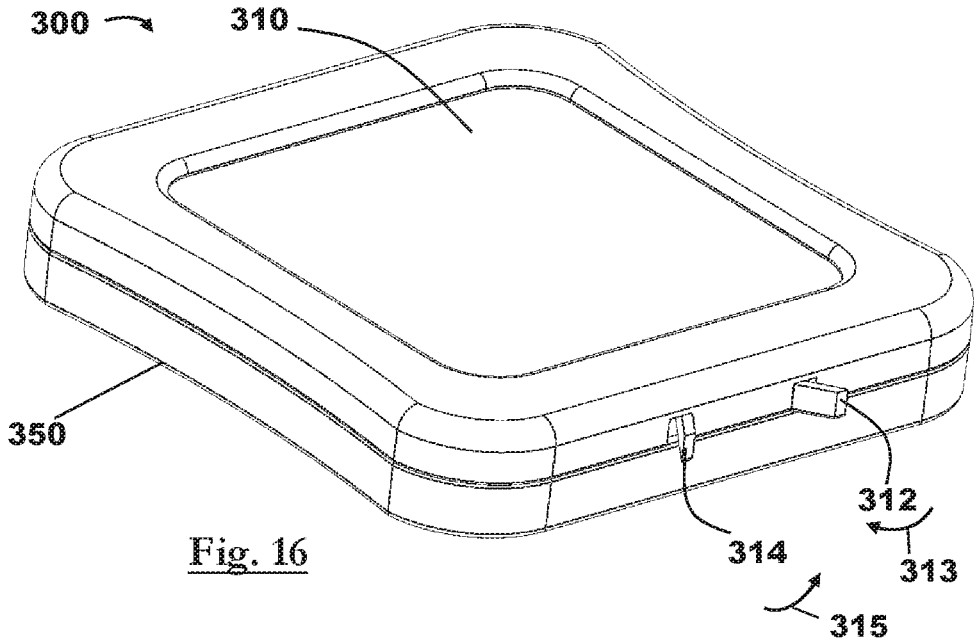
FIG. 16 is a perspective view of a container of an embodiment of the presently disclosed technology, wherein the container is shown in a first or closed configuration.

However, as stated earlier, retention member 260 is structured to be movable (e.g., in a direction 280, shown in FIG. 15, or in an inward direction toward a geometric center of the container 200). Accordingly, if a user presses button mechanism 264 and causes retention member 260 to deflect in direction 280, there will be no interference between protrusion 262 and groove 214, thereby allowing lid 210 to be opened. Furthermore, container 200 is provided with a plurality of gripping portions (see, for example, gripping portions 220 of lid 210 in FIG. 15), which allow lid 210 to more easily be opened by a user.

Thus, when a user desires to open container 200, the user must perform two operations to open container 200. First, the user must deflect each retention member 260, 270 inwardly (i.e., to release the protrusions 262 and the protrusion of retention member 270). Second, once retention member 260 have been deflected and there is no interference, the user can open lid 210 by way of pivoting lid 210 with respect to base 250.

A third embodiment of a container 300 according to the disclosed concept is shown in FIGS. 16-21. Container 300 includes a lid 310 and a base 350 optionally connected to lid 310 by a hinge. In accordance with the disclosed concept, container 300 further includes a child-resistant, senior-friendly feature.

Figure 17:
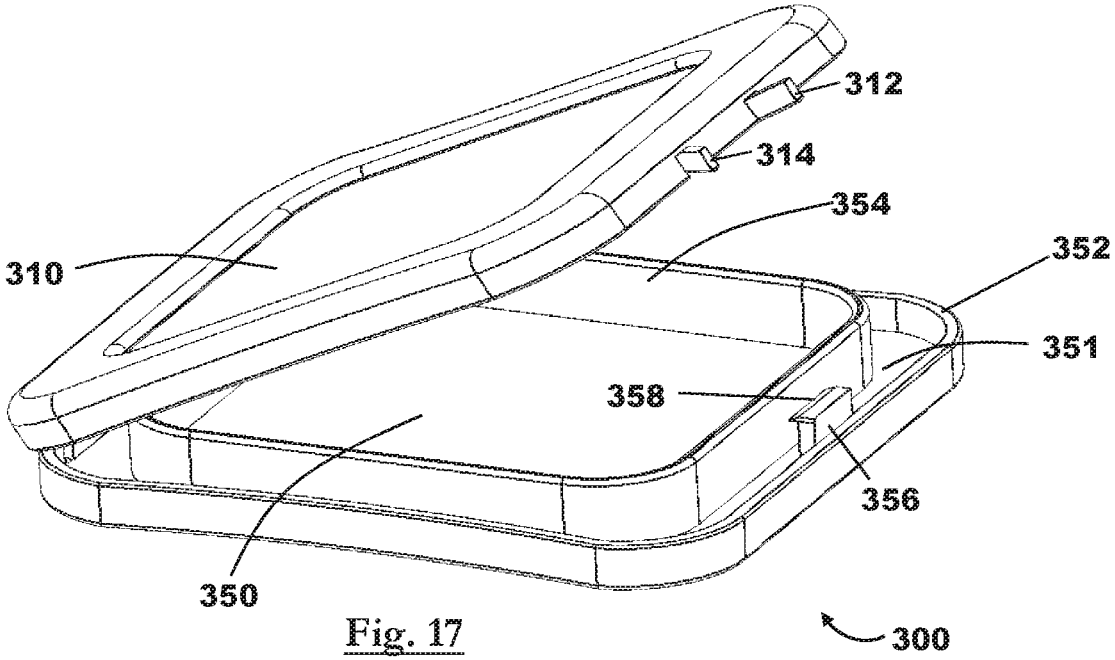
FIG. 17 is a perspective view of the container of FIG. 16, wherein the container is shown in a second or open configuration.
Figure 18:
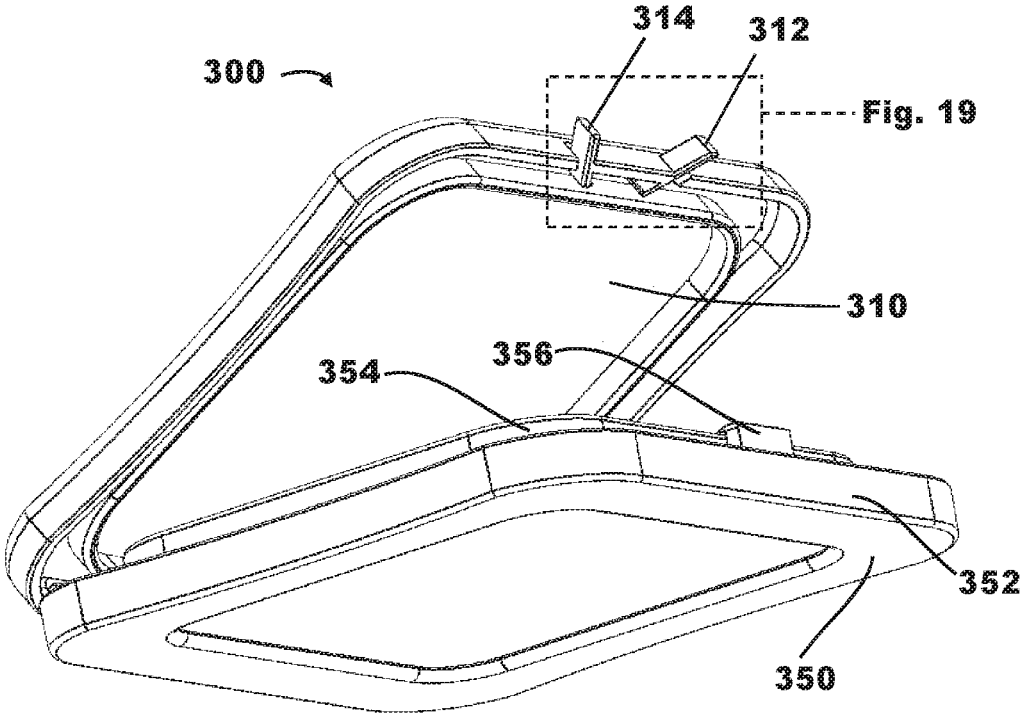
FIG. 18 is another perspective view of the container of FIG. 17.

Referring to FIG. 17, base 350 has a floor portion 351, outer wall 352, and inner wall 354. Furthermore, as shown, base 350 has at least one retention member 356 extending upwardly from floor portion 351 between inner wall 354 and outer wall 352. In one embodiment, retention member 356 is attached to or integrally formed with an inner surface of outer wall 352. As shown in FIG. 17, retention member 356 has at least one platform or projection 358. Optionally, each projection 358 can extend outwardly from retention member 356 away from the hinge.

Figure 19:
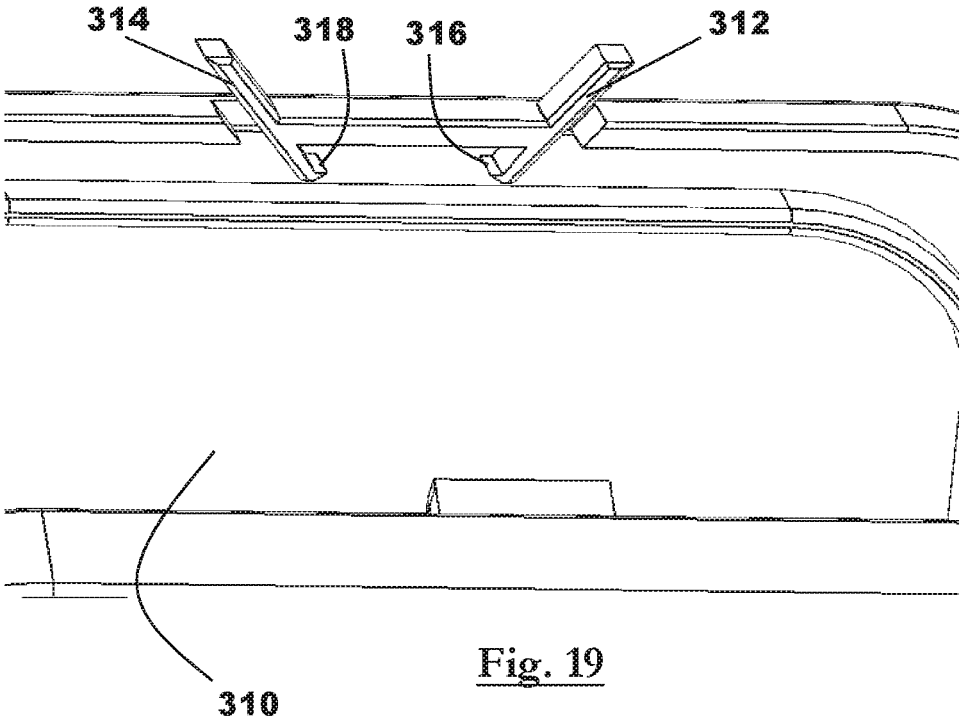
FIG. 19 is a magnified view of a portion of the container of FIG. 18.

Referring to FIG. 19, lid 310 includes a plurality of spaced-apart securing members 312, 314. Optionally, each securing member 312, 314 includes a hook portion 316, 318. Hook portion 316, 318 can be positioned on a distal or interior end of securing member 312, 314, respectively. In one embodiment, securing members 312, 214 are pivotally attached to lid 310. When container 300 is in the closed position, the interaction between at least one or both hook portions 316, 318 and platform 358 provide container 300 with a child-resistant, senior-friendly feature.

Figure 20:
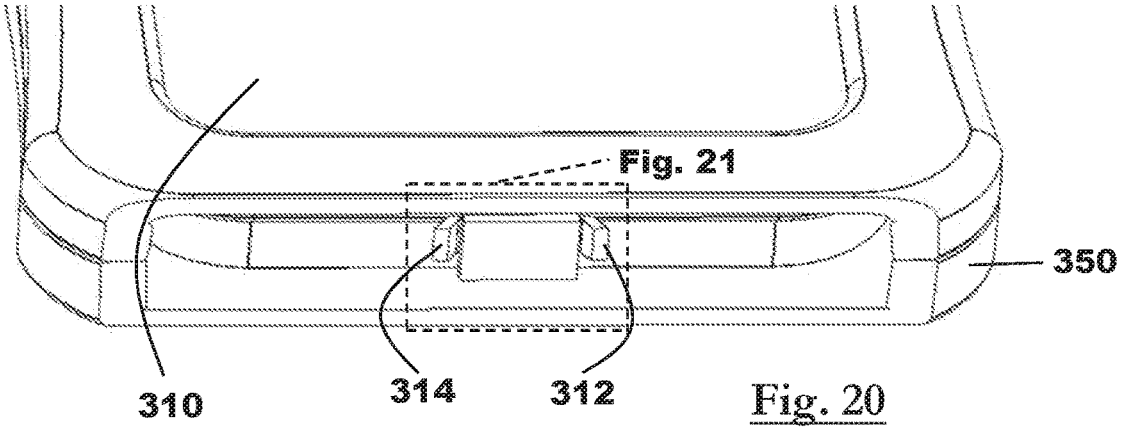
FIG. 20 is yet another perspective view of a portion of the container of FIG. 16.
Figure 21:
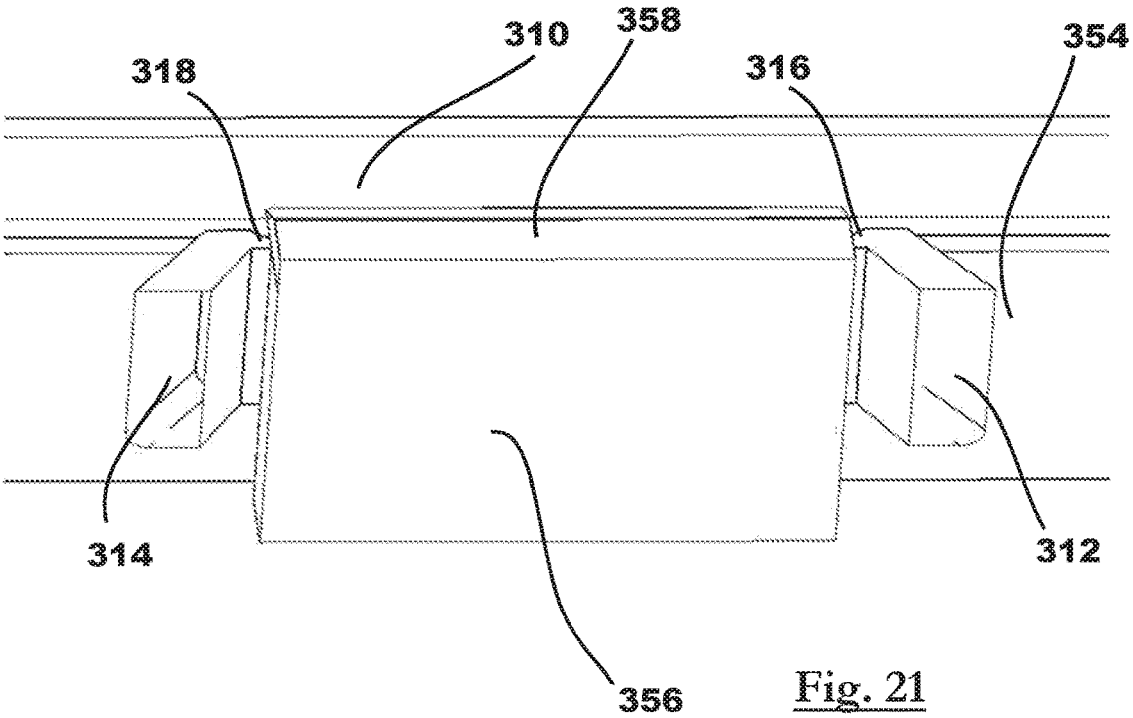
FIG. 21 is a magnified view of a portion of the container of FIG. 20.
Figure 22:
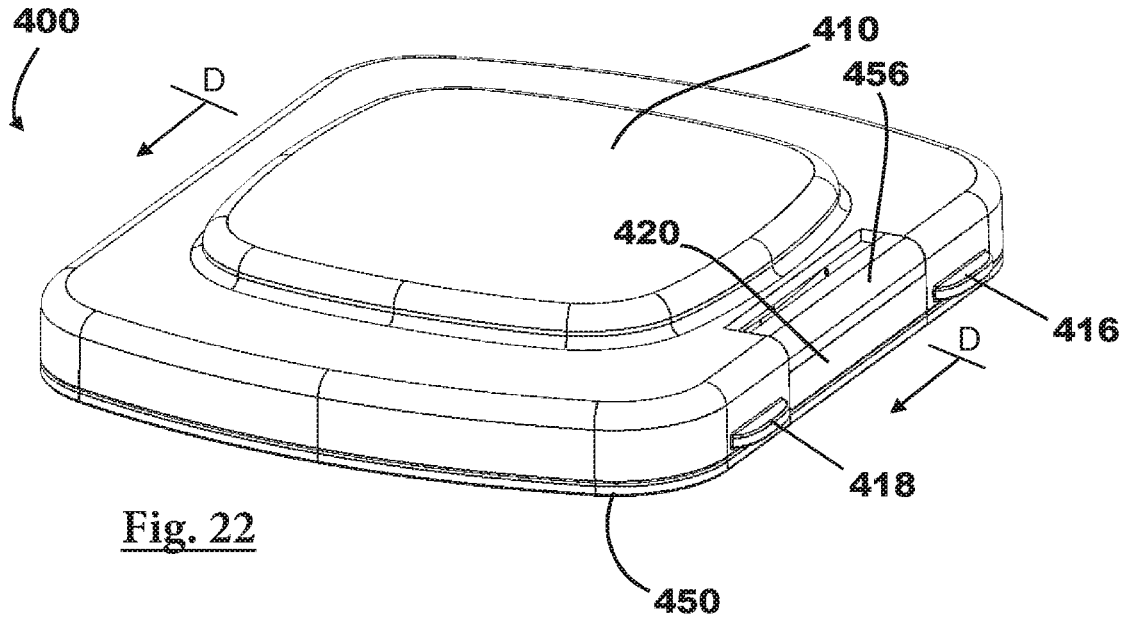
FIG. 22 is a perspective view of a container of an embodiment of the presently disclosed technology, wherein the container is shown in a first or closed configuration.

More specifically, as shown in FIGS. 20 and 21, when container 300 is in the closed position, hook portions 316, 318 are positioned below platform 358. In this manner, a typical opening motion (e.g., attempting to pivot the lid 310 with respect to the base 350) will not allow container 300 to be opened. That is, if a user attempts to open lid 310, at least a portion of hook portions 316, 318 will engage an underside of platform 358 and create an interference. Furthermore, securing members 312, 314 are biased toward the closed position. That is, outer ends of securing members 312, 314 (e.g., portions furthest from hinge) are biased to a position away from one another. Outer ends of securing members 312, 314 can be brought closer to one another (e.g., by a user placing the outer ends in between the thumb and the index finger, and then squeezing the outer ends toward each other). However, once that squeezing force is released, outer ends of securing members 312, 314 return to the position or orientation shown in FIG. 16.

In order to open container 300, a user must perform two separate operations. First, the user must eliminate the interference between hook portions 316, 318 and platform 358. In order to do this, the user must squeeze securing members 312, 314 toward each other. See, for example, directions 313, 315 in FIG. 16, which correspond to the respective directions that securing members 312, 314 can be squeezed by a user. Second, once securing members 312, 314 have been squeezed (e.g., in directions 313, 315), the user can simply open lid 310 by pivoting lid 310 with respect to base 350. In this manner, container 300 has a beneficial child-resistant, senior-friendly feature.

A fourth embodiment of a container 400 according to the disclosed concept is shown in FIGS. 22-26. Similar or identical structure between the embodiment of FIGS. 1-7 and the embodiment of FIGS. 22-26 is distinguished in FIGS. 22-26 by a reference number with a magnitude four hundred (400) greater than that of FIGS. 1-7. Description of certain similarities between the embodiment of FIGS. 1-7 and the embodiment of FIGS. 22-26 may be omitted herein for convenience and brevity only.

Figure 23:
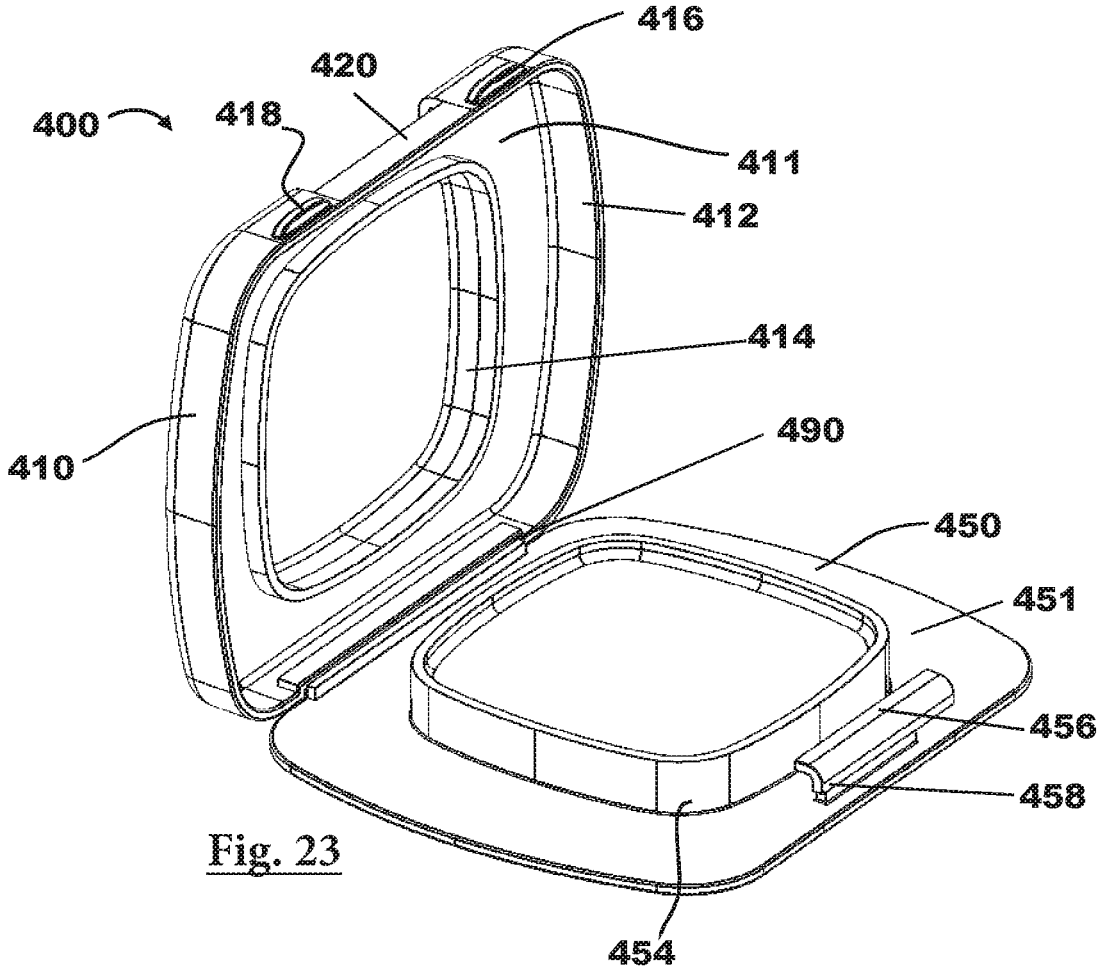
FIG. 23 is a perspective view of the container of FIG. 22, wherein the container is shown in a second or open configuration.

Container 400 includes lid 410 and base 450 optionally connected by a hinge (see, for example, hinge 490, shown in FIG. 23). In accordance with the disclosed concept, container 400 includes child-resistant senior-friendly means.

Figure 24:
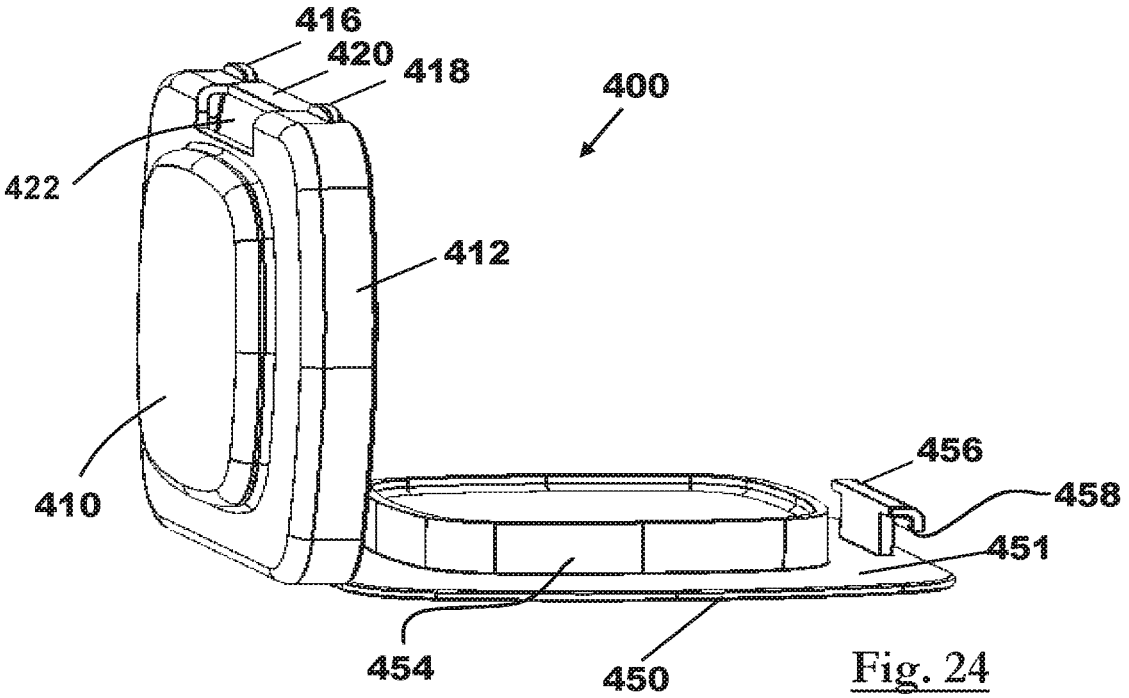
FIG. 24 is another perspective view of the container of FIG. 23.
Figure 25:
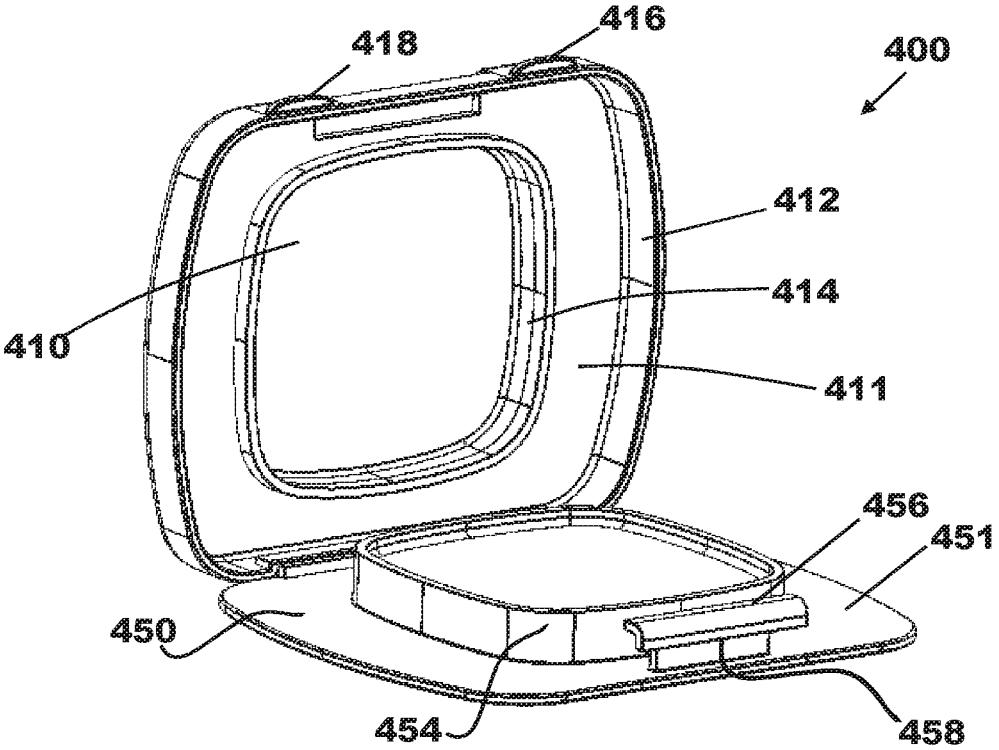
FIG. 25 is yet another perspective view of the container of FIG. 23.

More specifically, and with reference to FIGS. 23-25, base 450 has floor portion 451. An annular-shaped wall 454 extends upwardly from floor portion 451 and at least one latching portion 456 extends upwardly from floor portion 451. Optionally, the entire annular-shaped wall 454 is spaced inwardly from the entire outer edge of floor portion 451. Further, latching portion 456 is spaced inwardly from the outer edge of floor portion 451, and between annular-shaped wall 454 and the outer edge of floor portion 451. Optionally, latching portion 456 is pivotable with respect to floor portion 451. Latching portion 456 can be positioned on base 450 opposite hinge 490.

Lid 410 includes ceiling portion 411, outer wall 412 extending downwardly from ceiling portion 411, and inner wall 414 extending downwardly from ceiling portion 411. The entire inner wall 414 is spaced-apart from and located internal with respect to outer wall 412. Product can be located within inner wall 414. Outer wall 412 includes at least one or a plurality of tabs 416, 418. Optionally, a maintaining portion 420 is located between two of tabs 416, 418. As shown most clearly in FIG. 24, lid 410 has an edge portion 422 defining a hole extending through lid 410. The hole of the present embodiment is distinct from the cut-out in the lid of the first embodiment (see FIG. 1), because the hole in the present embodiment is surrounded on all sides by lid 410. When container 400 is in the closed position, at least a portion of latching portion 456 of base 450 is sized, shaped and/or structured to extend through the thru hole to prove the child-resistant senior-friendly feature of container 400.

Figure 26:
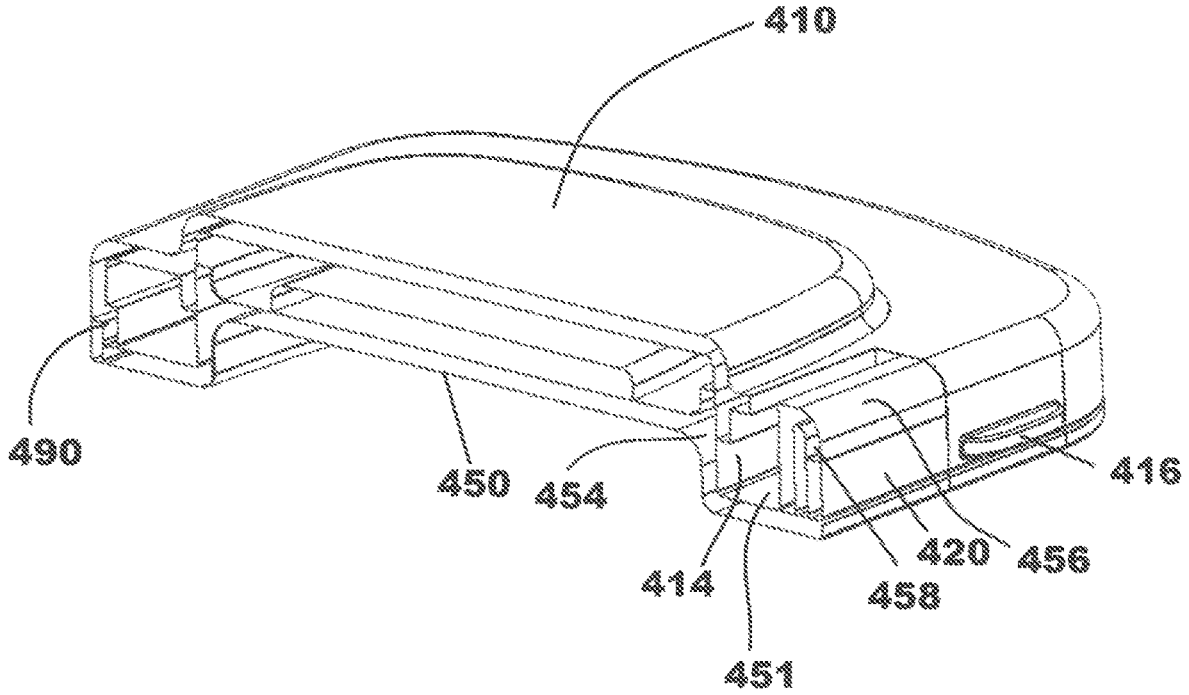
FIG. 26 is a cross-sectional elevation view taken along line D-D of FIG. 22.
Figure 27:
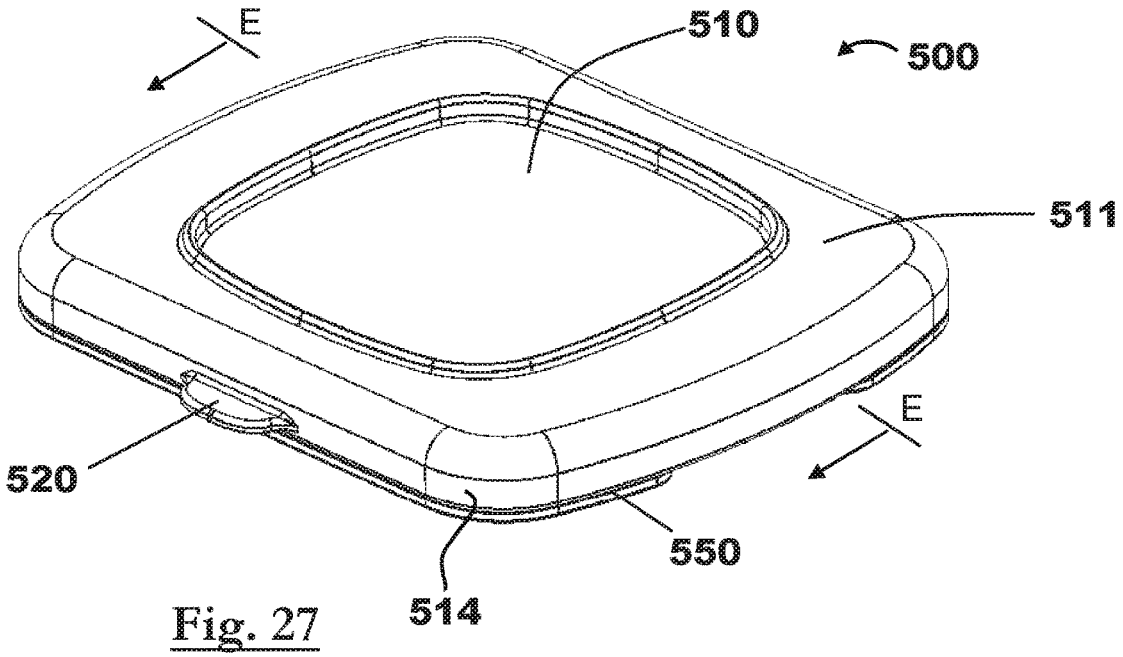
FIG. 27 is a perspective view of a container of an embodiment of the presently disclosed technology, wherein the container is shown in a first or closed configuration.
Figure 28:
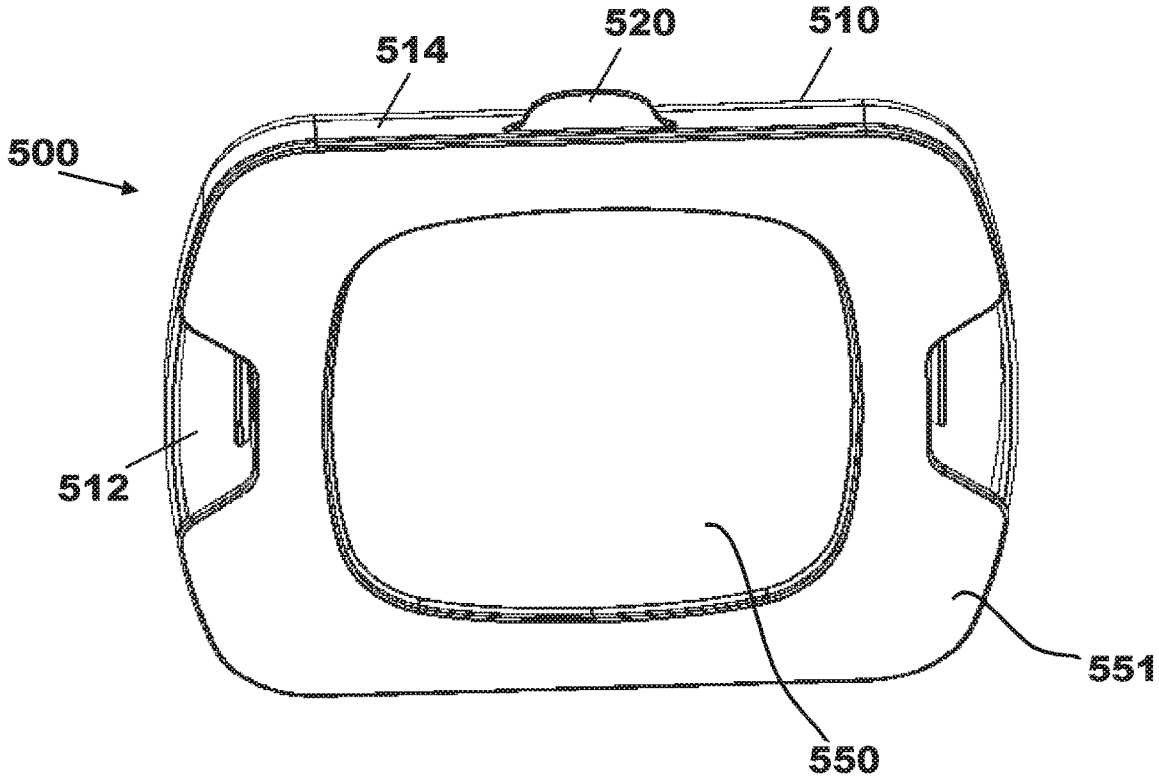
FIG. 28 is another perspective view of the container of FIG. 27.
Figure 29:
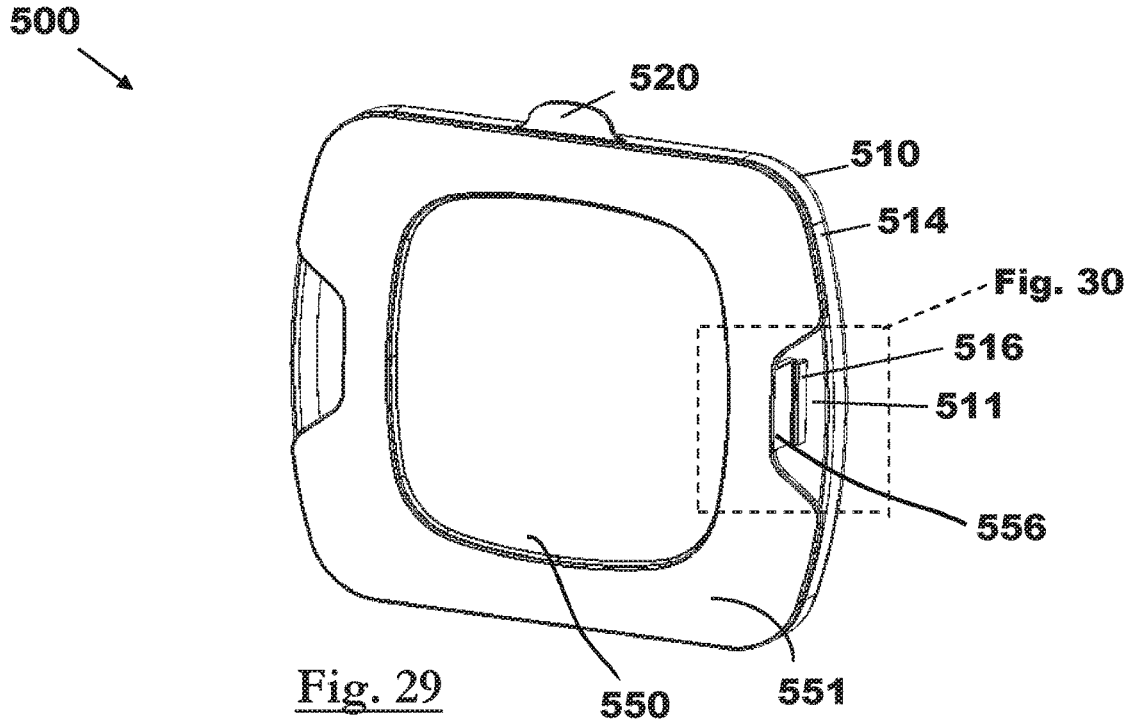
FIG. 29 is yet another perspective view of the container of FIG. 27.
Figure 30:
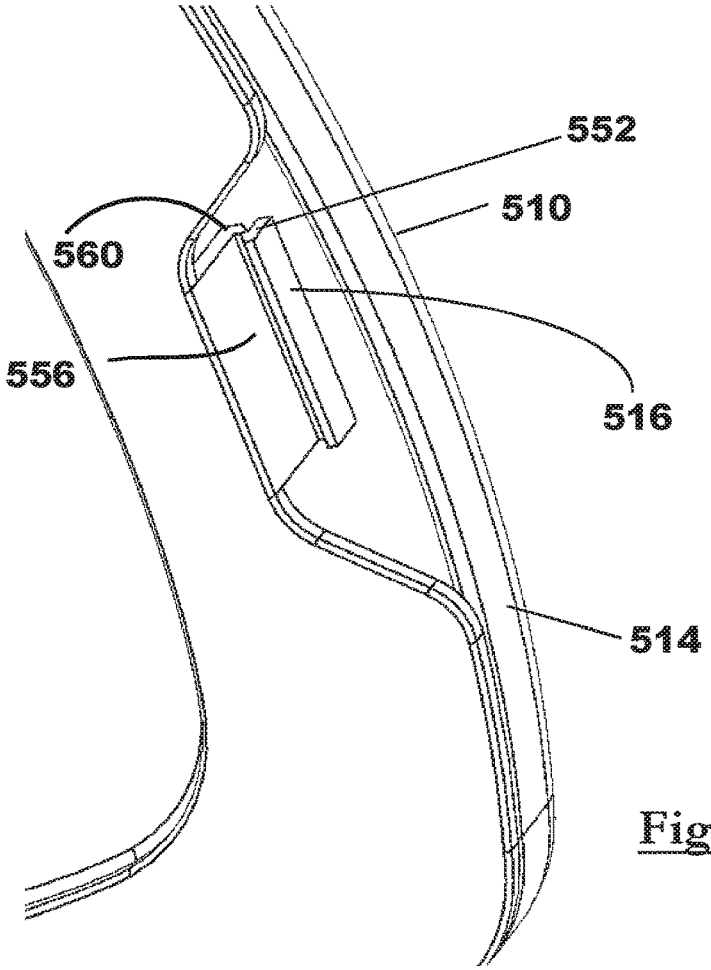
FIG. 30 is a magnified view of a portion of the container of FIG. 29.

More specifically, as shown in FIG. 26, when container 400 is in the closed position (e.g., such that pills, tablets, and the like are enclosed therein), maintaining portion 420 is disposed between a distal or free end or lip 458 of latching portion 456 and floor portion 451. In this manner, lid 410 is prevented from moving to the open position. That is, at least one or both of distal portion 458 and floor portion 451 engage or hold maintaining portion 420 therebetween.

Referring to FIG. 24, optionally, lip 458 extends outwardly from latching portion 456 in a direction opposite hinge 490. More specifically, the interior side or surface of latching portion 456 is flat. Lip 458 can extend in an arcuate manner outwardly from the exterior side or surface of latching portion 456. Thus, lip 458 forms an area or cavity to capture at least a portion of lid 410 (e.g., such as maintaining portion 420 thereof) when container 400 is in the closed position.

Container 400 is able to be moved to the open position by a simple motion that is readily apparent to someone other than a child. If an adult desires to open container 400, the adult can press latching portion 456 inwards (e.g., at least slightly pivot latching portion 456 about floor portion 451 and/or move latching portion 456 toward hinge 490) until distal portion 458 no longer obstructs maintaining portion 420 of lid 410. At this point, the user can push or pull on one and/or both of tabs 416, 418 (or another part of lid 410) to open lid 410. If the user desires to close lid 410, the user can move lid 410 in the opposite direction toward the closed position until maintaining portion 420 engages latching portion 456. Continued movement of maintaining portion 420 toward the closed position will cause latching portion 456 to pivot toward hinge 490 (e.g., inward toward a geometric center of container 400). Once maintaining portion 420 moves past latching portion 456, latching portion 456, which is biased toward the closed position, will pivot back away from hinge 490 until it is in the closed position (e.g., engaging maintaining portion 420). In this manner, container 400 has a child-resistant senior-friendly feature.

A fifth embodiment of a container 500 according to the disclosed concept is shown in FIGS. 27-34. Similar or identical structure between the embodiment of FIGS. 1-7 and the embodiment of FIGS. 27-34 is distinguished in FIGS. 27-34 by a reference number with a magnitude five hundred (500) greater than that of FIGS. 1-7. Description of certain similarities between the embodiment of FIGS. 1-7 and the embodiment of FIGS. 27-34 may be omitted herein for convenience and brevity only.

Figure 32:
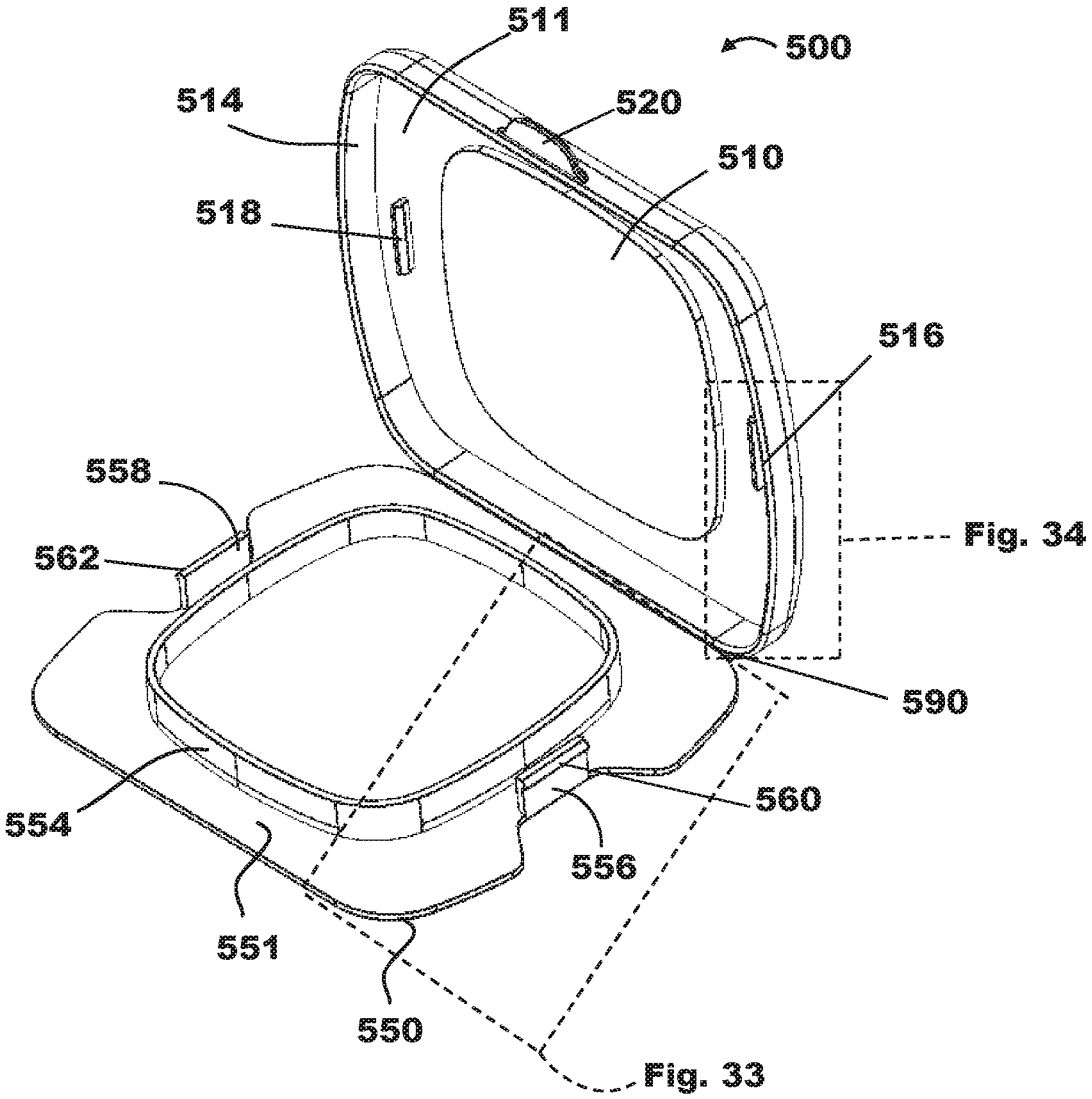
FIG. 32 is still another perspective view of the container of FIG. 27, wherein the container is shown in a second or open configuration.
Figure 33:
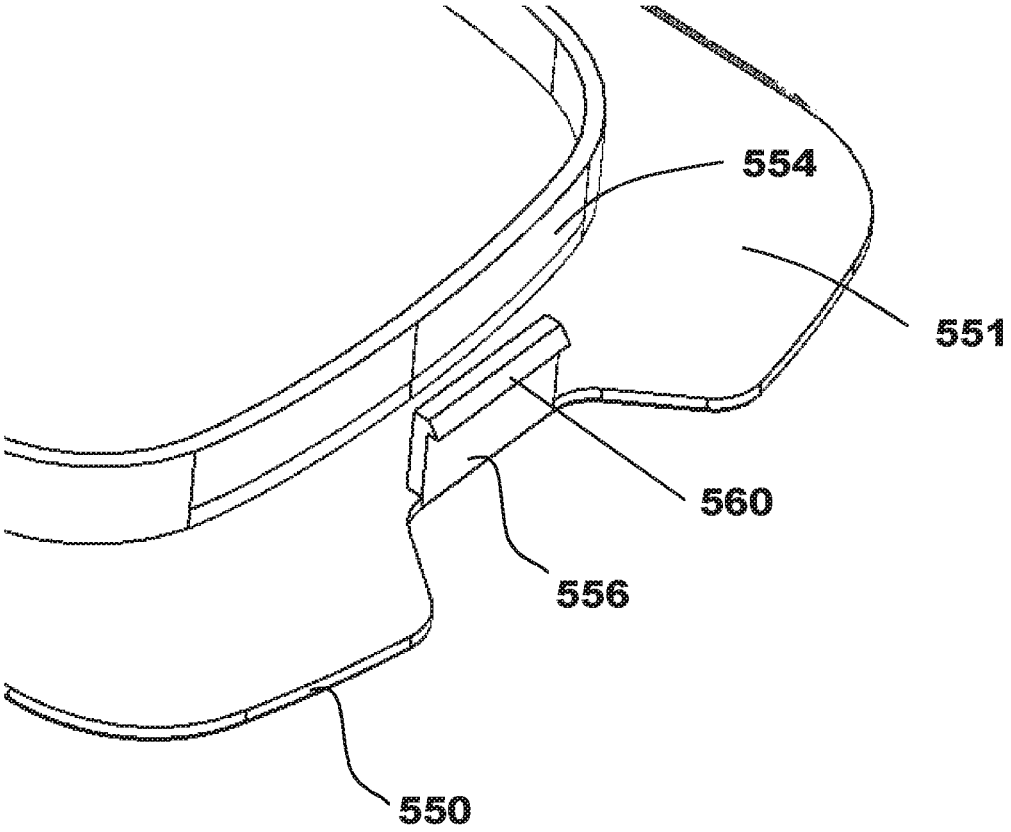
FIG. 33 is a magnified view of a portion of the container of FIG. 32.

Container 500 includes lid 510 and base 550 optionally connected to lid 510 by a hinge (see, for example, hinge 590, shown in FIG. 32). In accordance with the disclosed concept, container 500 includes child-resistant senior-friendly means.

More specifically, as shown in FIG. 32, base 550 has a floor portion 551, a wall 554 extending upwardly from floor portion 551, and at least one or a pair of opposing deflection members 556, 558 extending upwardly from and being optionally perpendicular to floor portion 551. Optionally, the entire wall 554 is spaced inwardly from an outer edge of floor portion 551. Further, each deflection member 556, 558 can be located in a cut-out formed in floor portion 551. Optionally, each deflection member 556, 558 is outwardly spaced-apart from the wall 554. Of course, each deflection member 556, 558 could extend from the base 550 in an alternative embodiment. Each deflection member 556, 558 optionally includes hook portion 560, 562, respectively, at a distal portion or free end thereof. Hook portions 560, 562 can extend in opposite directions (e.g., one to the left of container 500 and one to the right of container 500).

Lid 510 includes ceiling portion 511 and wall 514 extending downwardly therefrom and optionally being perpendicular to ceiling portion 511. Wall 514 can be located at an outer periphery or edge of body portion 512, such that the entire wall 514 surrounds the entire wall 554 when container 500 is in the closed position. At least one or pair of opposing retaining portions or member 516, 518 extend downwardly from and optionally perpendicular to ceiling portion 511. Each retaining portion 516, 518 can be spaced inwardly from the outer periphery of the ceiling portion 511. At least one tab 520 can extend radially outwardly from wall 514.

Figure 34:
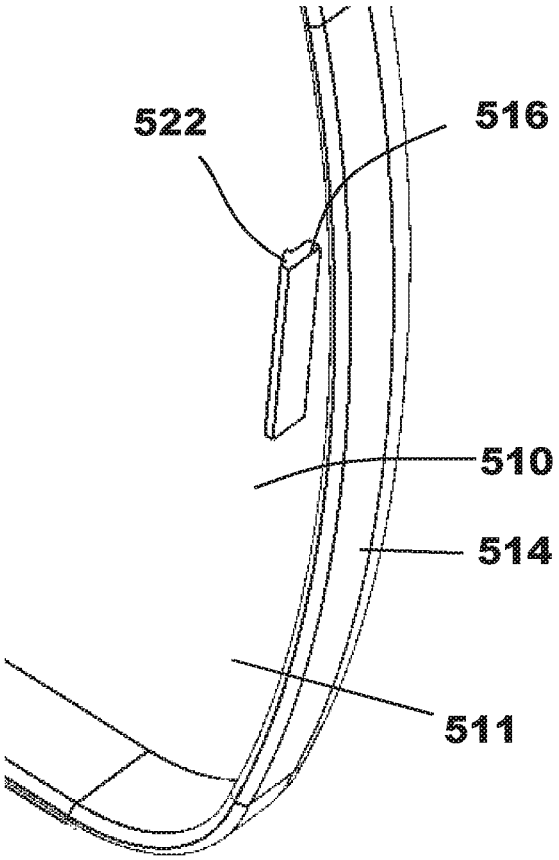
FIG. 34 is a magnified view of another portion of the container of FIG. 33.

As shown in FIG. 34, retaining portion 516 includes a hook portion 522 at a distal portion or free end thereof. It will be appreciated that retaining portion 518 likewise has a hook portion at a distal portion or free end thereof. Each of the hook portions 522 extend or point inwardly toward the center of container 500. Interaction between at least one of the hook portions of retaining portions 516, 518 and at least one of the hook portions of deflection members 556, 558 advantageously provides a child-resistant senior-friendly feature for container 500.

Figure 31:
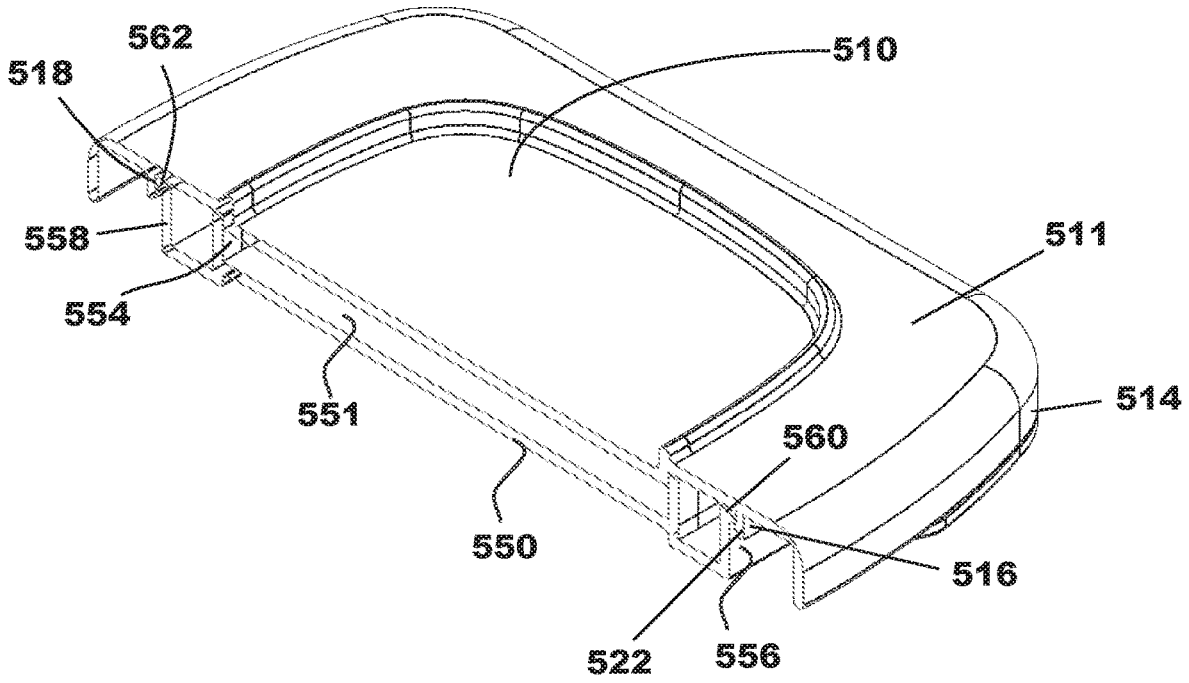
FIG. 31 is a cross-sectional view taken along line E-E of FIG. 27.

More specifically, as shown in FIG. 31, when container 500 of one embodiment is in the closed position, hook portions 522 of retaining portion 516 engages hook portion 560 of deflection member 556, and the hook portion of retaining portion 518 engages hook portion 562 of deflection member 558. In this manner, lid 510 is prevented from being opened by a simple opening motion, such as, for example and without limitation, an opening motion by a child trying to pivot lid 510 about hinge 590. However, in accordance with the disclosed concept, an adult using container 500 is provided with a relatively simple mechanism to open container 500 (i.e., senior-friendly means).

More precisely, the adult can simply deflect (e.g., pinch) the sole deflection member or each deflection member 556, 558 toward each other (i.e., pivot them about floor portion 551 radially inwardly and/or toward each other). In this manner, hook portion 560 will disengage (i.e., will no longer obstruct and prevent an opening motion to occur) hook portion 522, and hook portion 562 will disengage (i.e., will no longer obstruct and prevent an opening motion to occur) the hook portion of retaining portion 518. Accordingly, when hook portions 522, 560, 562 are disengaged from each other, lid 510 can be opened in a relatively simple conventional opening motion (e.g., without limitation, pivoting tab 520 about hinge 590). In this manner, container 500 has a beneficial child-resistant senior-friendly feature.

A sixth embodiment of a container 600 according to the disclosed concept is shown in FIGS. 35-39. Similar or identical structure between the embodiment of FIGS. 1-7 and the embodiment of FIGS. 35-39 is distinguished in FIGS. 35-39 by a reference number with a magnitude six hundred (600) greater than that of FIGS. 1-7. Description of certain similarities between the embodiment of FIGS. 1-7 and the embodiment of FIGS. 35-39 may be omitted herein for convenience and brevity only.

Figure 35:
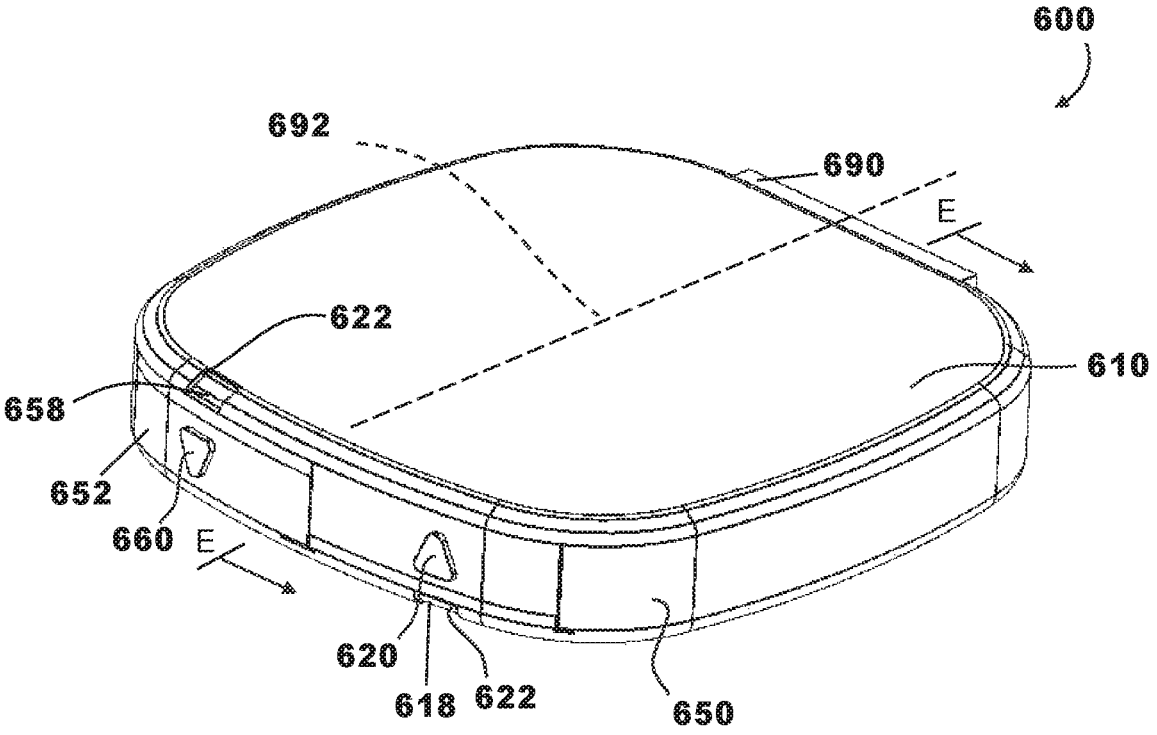
FIG. 35 is a perspective view of a container of an embodiment of the presently disclosed technology, wherein the container is shown in a first or closed configuration.

Container 600 includes a lid 610 and a base 650 optionally connected to lid 610 by a hinge (see, for example, hinge 690, shown in FIG. 35). In accordance with the disclosed concept, container 600 further includes a child-resistant senior-friendly feature.

Base 650 includes a floor portion 651, an outer wall 652 extending upwardly from and optionally perpendicular to floor portion 651, an inner wall 654 extending upwardly from and optionally perpendicular to floor portion 651. Outer wall 652 can extend around an entire periphery of floor portion 651. In contrast, inner wall 654 extends optionally laterally across floor portion 651. Inner wall 654 is spaced inwardly from outer wall 652.

Figure 37:
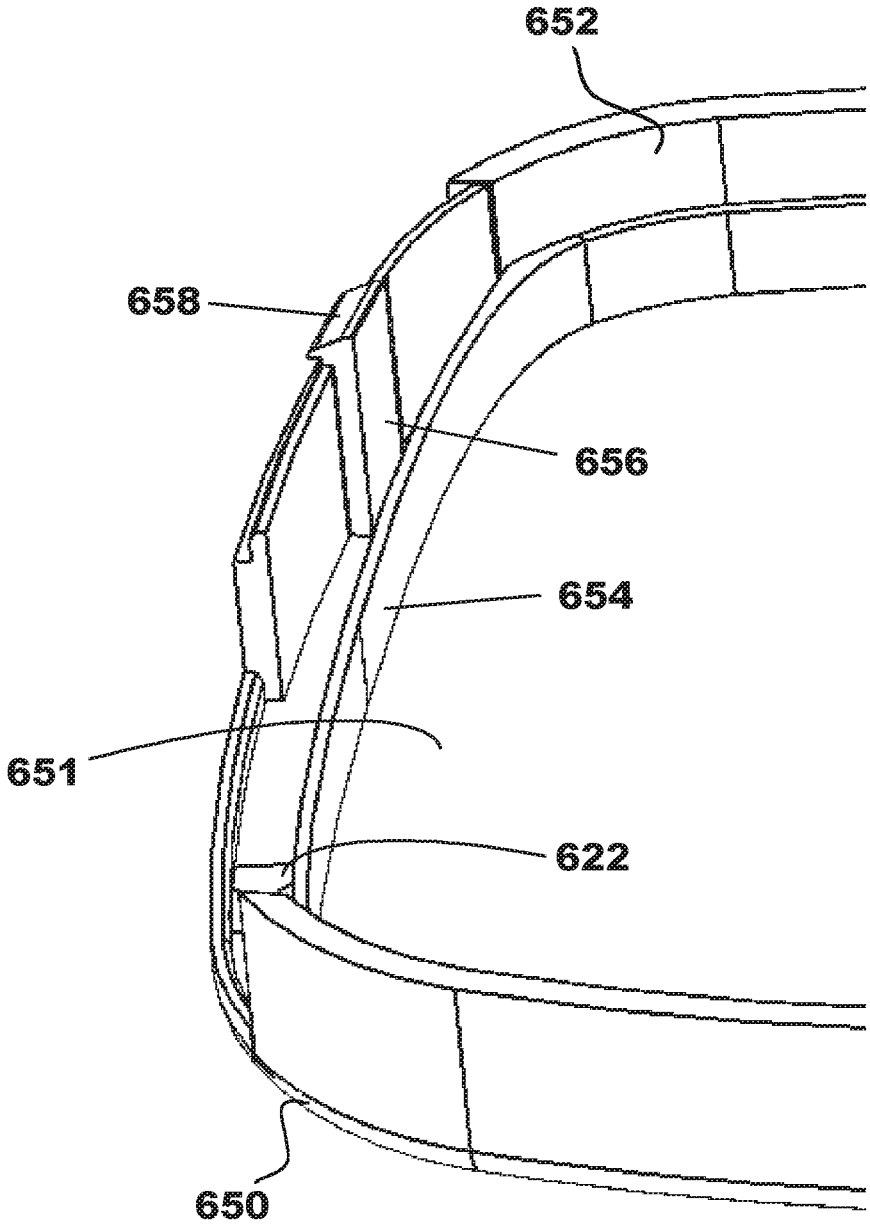
FIG. 37 is a magnified view of a portion of the container of FIG. 36.

At least one maintaining tab 656 extends upwardly away from and optionally perpendicular to floor portion 651. A lower end of maintaining tab 656 can contact or be coplanar with floor portion 651, or lower end of maintaining tab 656 can be at least slightly spaced-apart from floor portion 651. At least one button mechanism 660 extends laterally (e.g., to the front) outwardly from outer wall 652. The at least one button mechanism 660 can be integrally or unitarily formed with the at least one maintaining tab 656. Additionally, as shown in FIG. 37, floor portion 651 has a hole (thru hole) at an edge portion 662 thereof. The hole or edge portion 662 can be spaced-apart from the at least one maintaining tab 656. For example, the edge portion 662 can be located on a right side of the floor portion 651 (e.g., to the right of imaginary center line 692 of container 600), while the maintaining tab 656 can be located on a left side of the floor portion 651.

Figure 36:
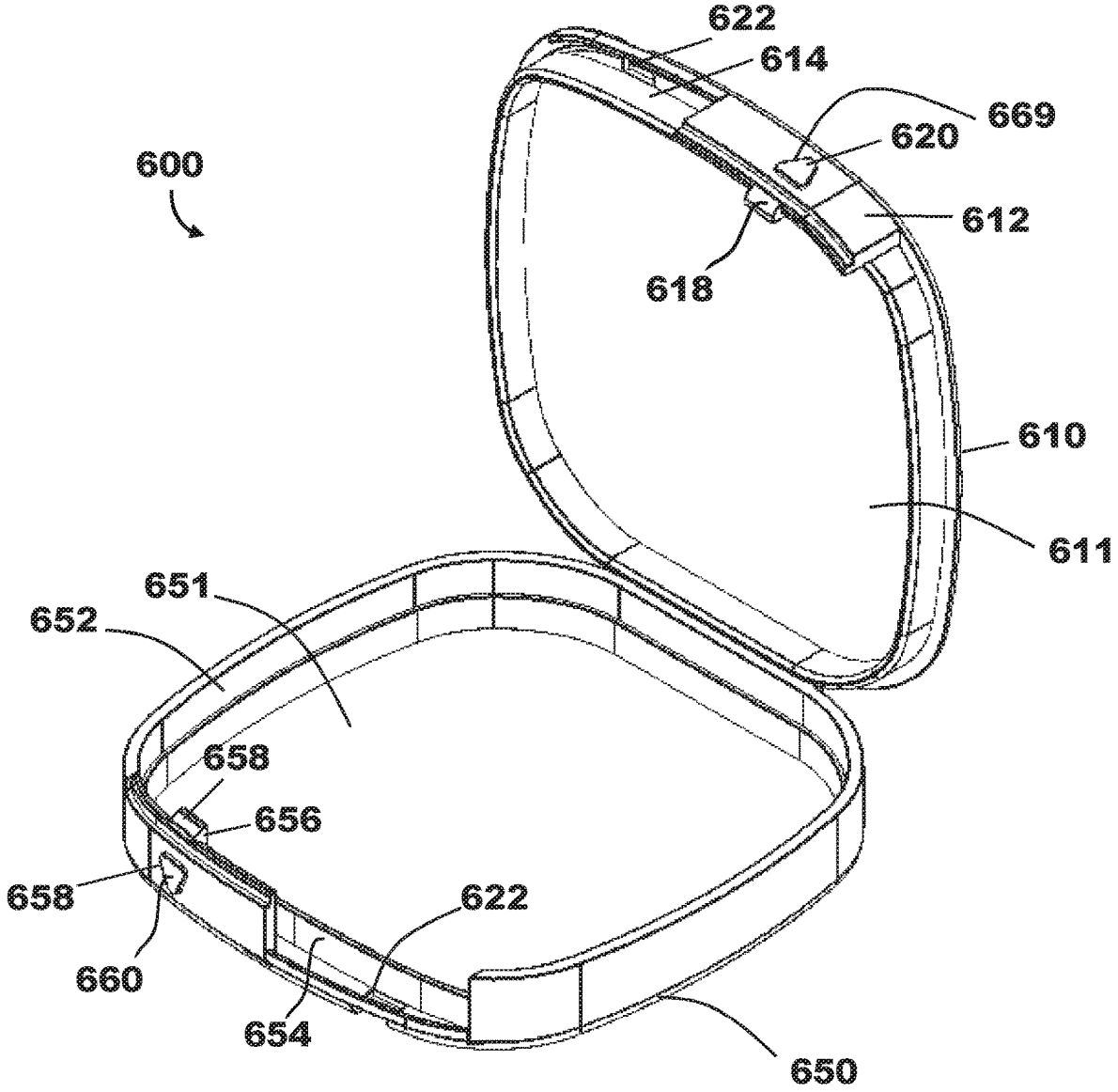
FIG. 36 is a perspective view of the container of FIG. 35, wherein the container is shown in a second or open configuration.

Optionally, the at least one maintaining tab 656 can be spaced at least slightly inwardly from outer wall 652. In such a configuration, as shown in FIGS. 36 and 37, an outer surface of the maintaining tab 656 can be in contact with or be in close proximity to an inner surface of outer wall 652. In an alternative embodiment, the at least one maintaining tab 656 can be formed as a cut-out in outer wall 652, such that an outer or exterior surface of the maintaining tab 656 is generally or exactly co-planar to an outer or exterior surface of outer wall 652. Optionally, the at least one maintaining tab 656 is positioned or located on a first side or left side of center line 692 of container 600 (when viewing container 600 from the front side). In addition, in one embodiment, a distal or free end of the at least one maintaining tab 656 extends above a top surface of outer wall 652.

Referring to FIG. 36, lid 610 can be structured in a similar manner as base 650. For example, lid 610 includes roof or ceiling portion 611, outer wall 612 extending downwardly from and optionally perpendicular to ceiling portion 611, and inner wall 614 extending downwardly from and optionally perpendicular to ceiling portion 611. Outer wall 612 can extend around an entire periphery of ceiling portion 611. In contrast, inner wall 614 extends generally laterally across ceiling portion 611. Inner wall 614 is spaced inwardly from outer wall 612. At least one maintaining tab can extend downwardly from and optionally perpendicular to ceiling portion 611. At least one button mechanism 620 extends laterally outwardly from outer wall 612. The at least one button mechanism 620 can be integrally or unitarily formed with the at least one maintaining tab of lid 610. Additionally, as shown, ceiling portion 611 has an edge portion 622 defining a thru hole, which in one embodiment is at least slightly larger than a distal or free end of the at least one maintaining tab of lid 610. Optionally, the at least one maintaining tab of lid 610 is positioned or located on an opposing second side or right side of center line 692 of container 600 (when viewing container 600 from the front side). In addition, in one embodiment, the distal or free end of the at least one maintaining tab of the lid 610 extends below a bottom surface of outer wall 612.

Optionally, first aperture 668 extends through outer wall 652 of the base 650 and second aperture 669 extends through outer wall 612 of lid 610. At least a portion of button 660 of first tab 656 extends through first aperture 668 when the container 600 is in the closed position. At least a portion of button 620 of the second tab extends through second aperture 669 when container 600 is in the closed position.

Maintaining tab 656 of base 650 and the maintaining tab of lid 610 each have a corresponding hook portion 658, 618 at a distal portion or free end thereof. Interaction between hook portions 658, 618 and the thru holes defined by edge portions 662, 622 advantageously provides container 600 with a child-resistant senior-friendly feature.

Figure 38:
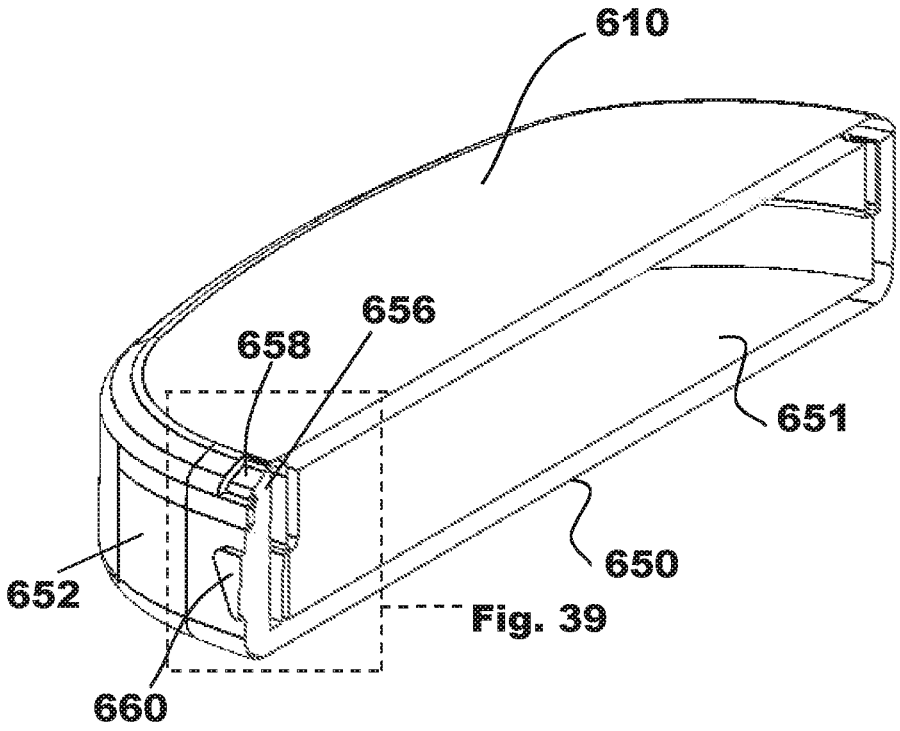
FIG. 38 is a cross-sectional view taken along line F-F of FIG. 35.
Figure 39:
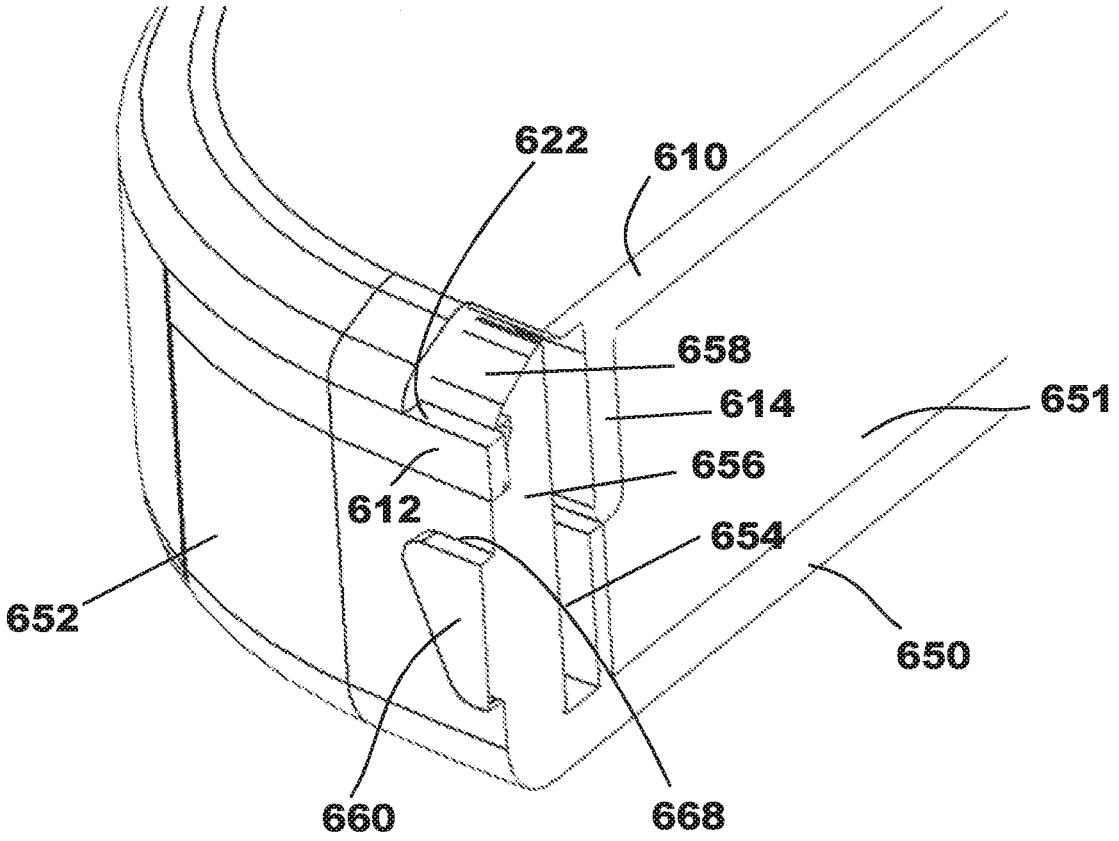
FIG. 39 is a magnified view of a portion of the container of FIG. 38.
Figure 40:
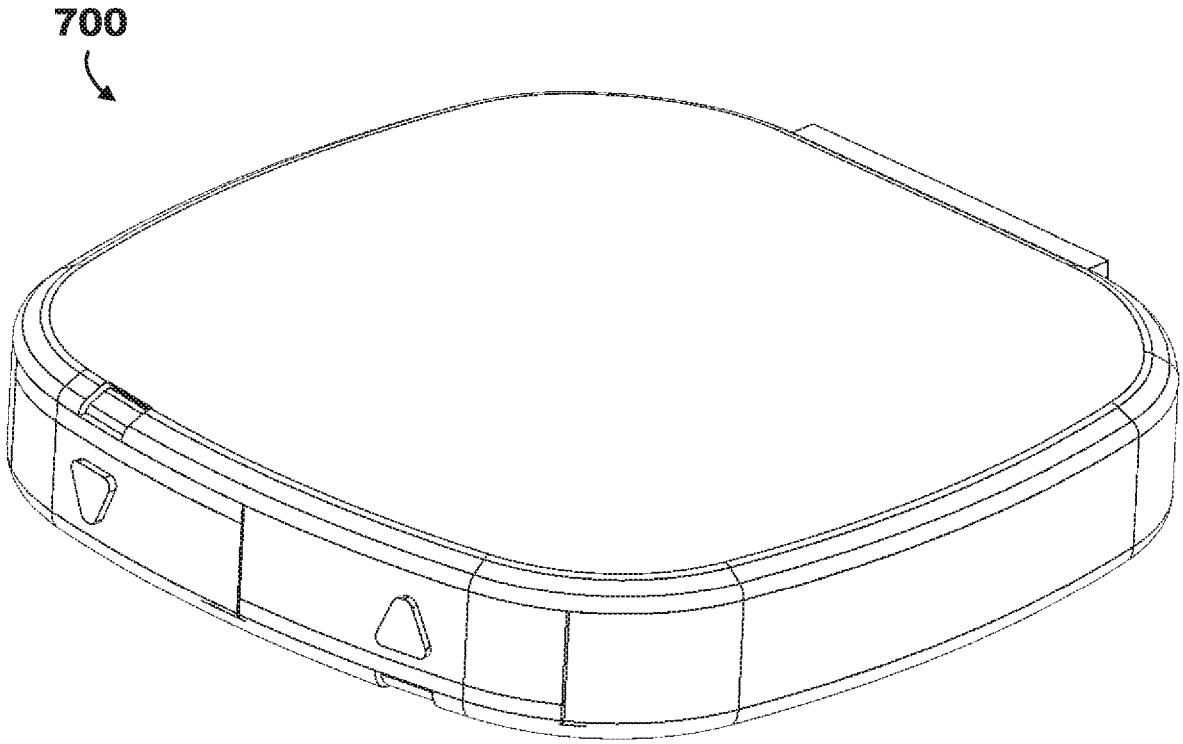
FIG. 40 is a top perspective view of a container of an embodiment of the presently disclosed technology, wherein the container is shown in a first or closed configuration.
Figure 41:
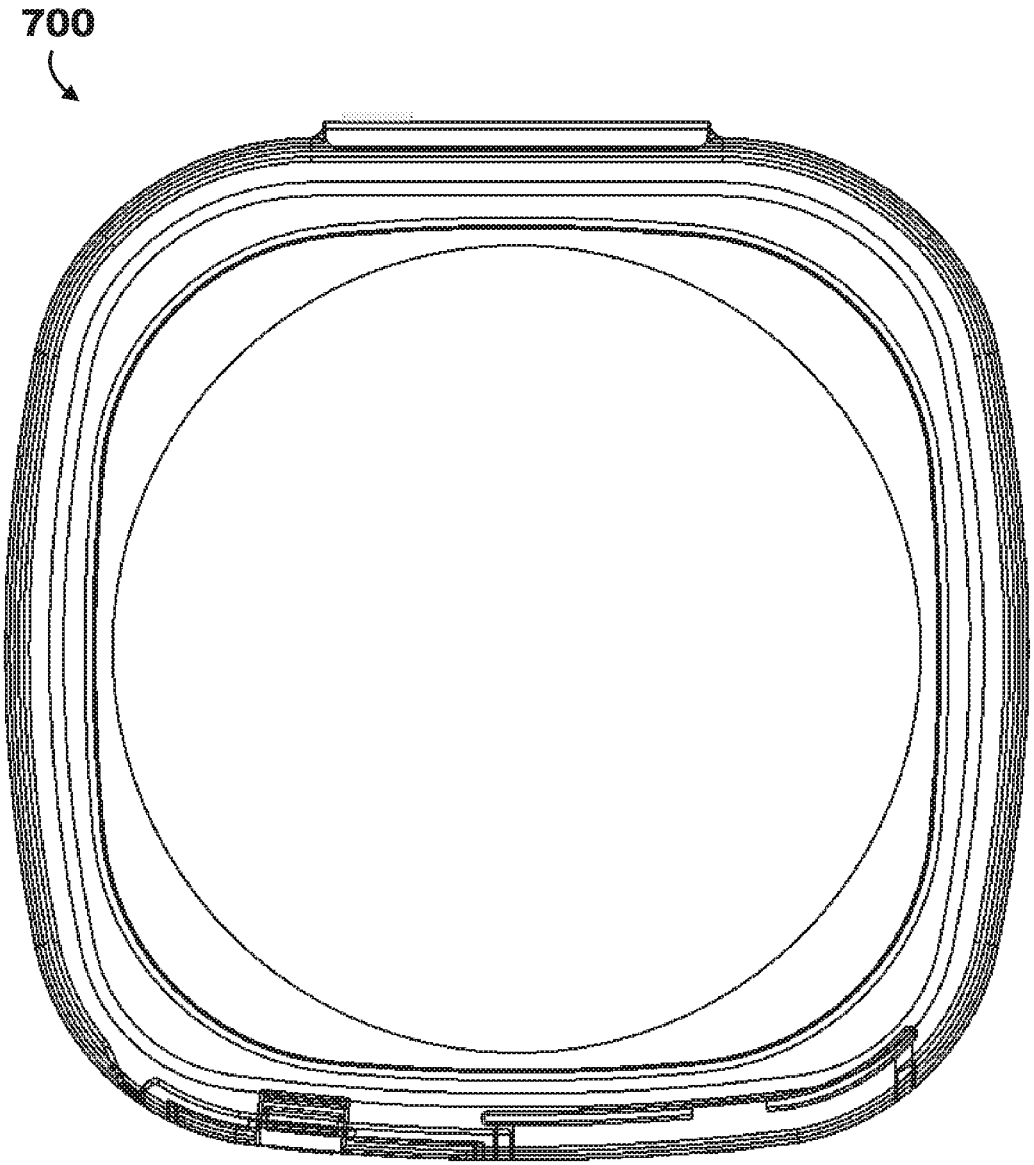
FIG. 41 is a top plan view thereof.
Figure 42:
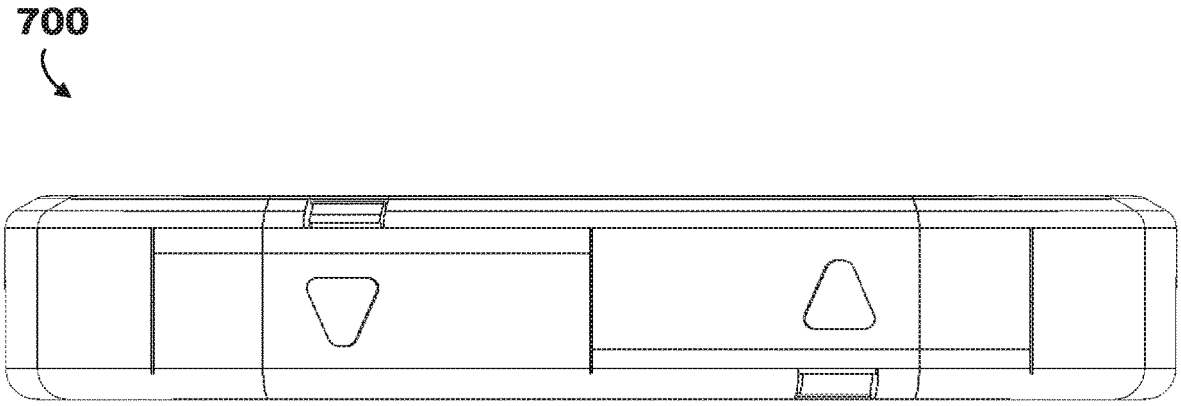
FIG. 42 is a front elevation view thereof.
Figure 43:
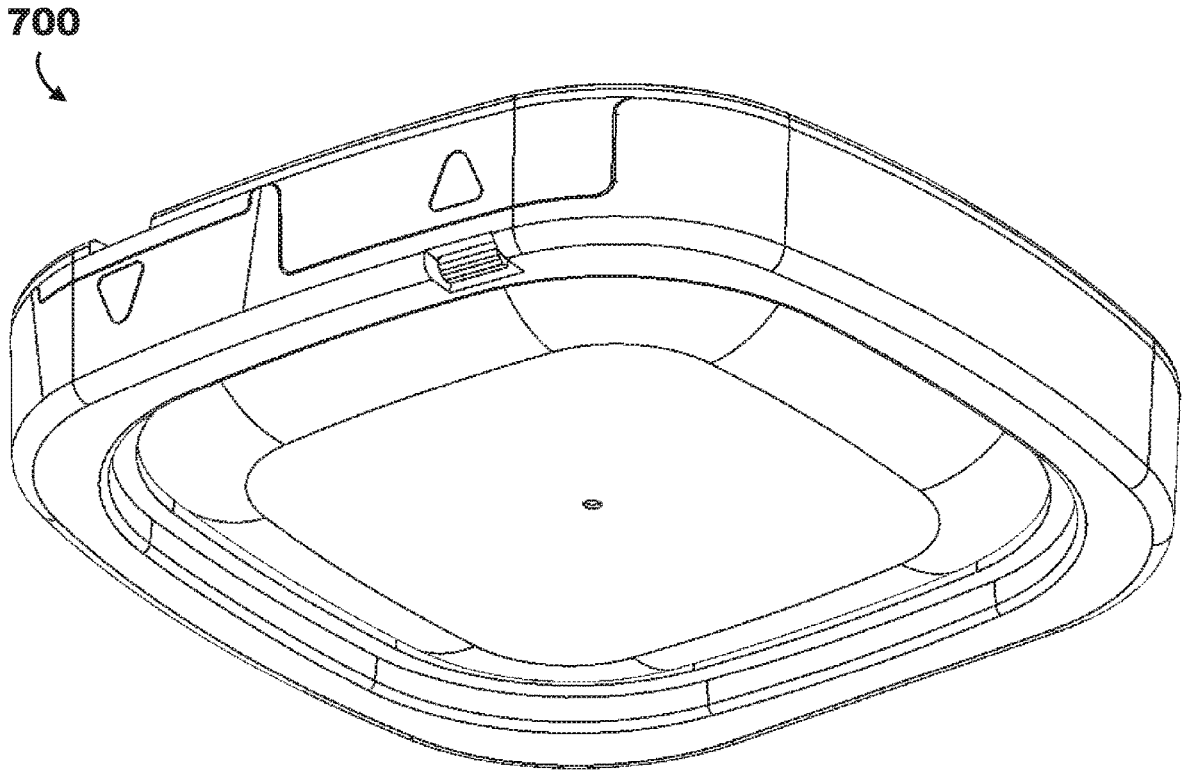
FIG. 43 is a bottom perspective view thereof.
Figure 44:
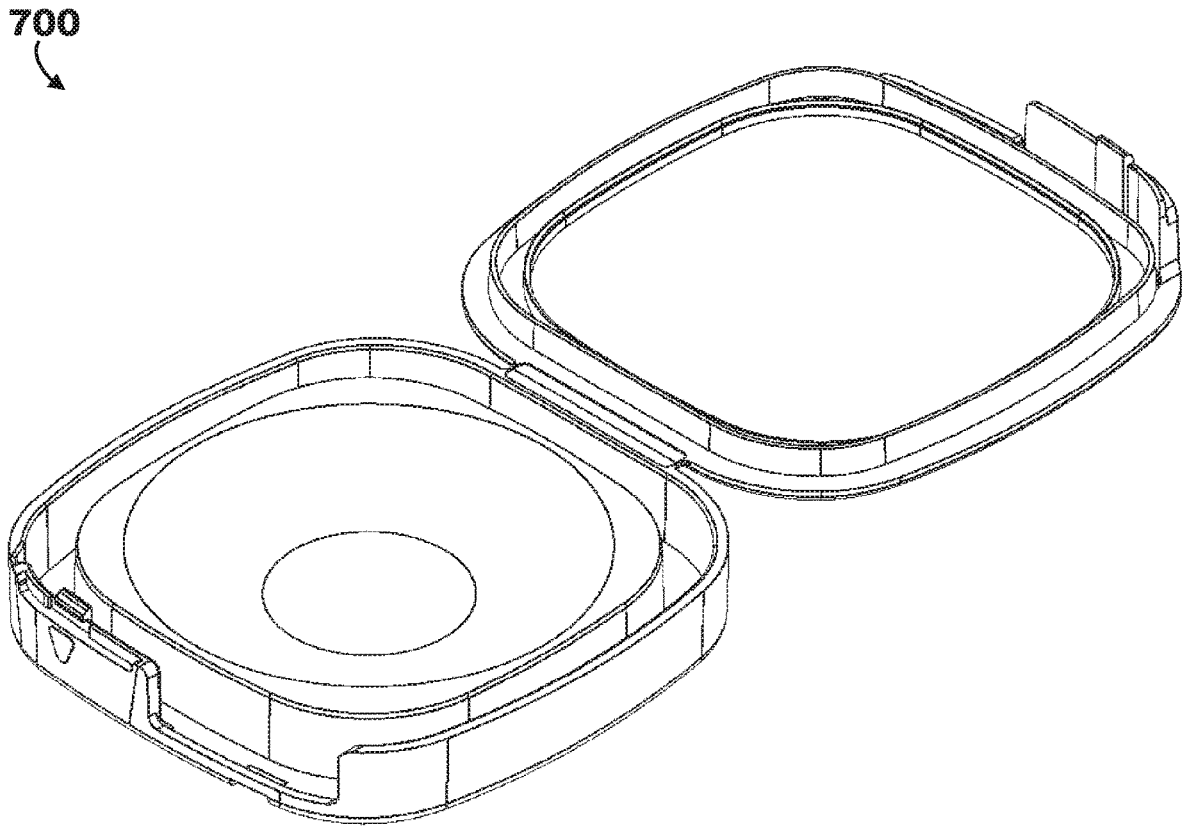
FIG. 44 is a top perspective view of the container of FIG. 40, wherein the container is shown in a second or open configuration.

More specifically, as shown in FIGS. 35, 38 and 39, when container 600 is in the closed position, hook portions 618, 658 engage respective edge portions 622, 662. As shown in FIG. 39, hook portion 658 blocks, engages or obstructs edge portion 622 such that lid 610 is prevented from being opened in a conventional manner. It will be appreciated that hook portion 618 and edge portion 662 function in an equivalent manner. However, in accordance with the disclosed concept, to open container 600, a user can press button mechanisms 620, 660 inwardly. When this happens, each of the maintaining tabs pivots about floor portion 651 or the ceiling portion 611. Once each of the maintaining tabs has pivoted far enough, the hook portion thereof will be disengaged from the respective edge portion. Once this process occurs, lid 610 can be easily opened (e.g., such as by pivoting the lid with respect to the base). In this manner, container 600 has a beneficial child-resistant senior-friendly feature. The present embodiment is not limited to including two separate and distinct maintaining tabs and edge portions. Instead, container 600 can include child-resistant senior-friendly means in the form of one maintaining tab extending from either the ceiling portion of the lid or the floor portion of the base and one edge portion located in the other of the base and the lid.

Optionally, in an embodiment including two maintaining tabs, each tab is pressed simultaneously to disengage the respective hook portion 618, 658 from the relevant portion of the container. Alternatively, the tabs can be pressed sequentially or in series.

Any of containers 100, 200, 300, 400, 500 or 600 may be employed to house, for example and without limitation, pills, tablets, gel-caps, capsules, and the like. Alternatively, any of such containers 100, 200, 300, 400, 500 or 600, may be used to house tobacco-containing substances, nicotine replacement formulations or *cannabis*-containing substances. The containers can be formed of a light-weight, high-strength material, such as a polymeric material or a metal alloy. The containers can be sized to fit within the palm of an individual's hand, or can be significantly large to hold relatively large product (e.g., cleaning supplies).

Figure 45:
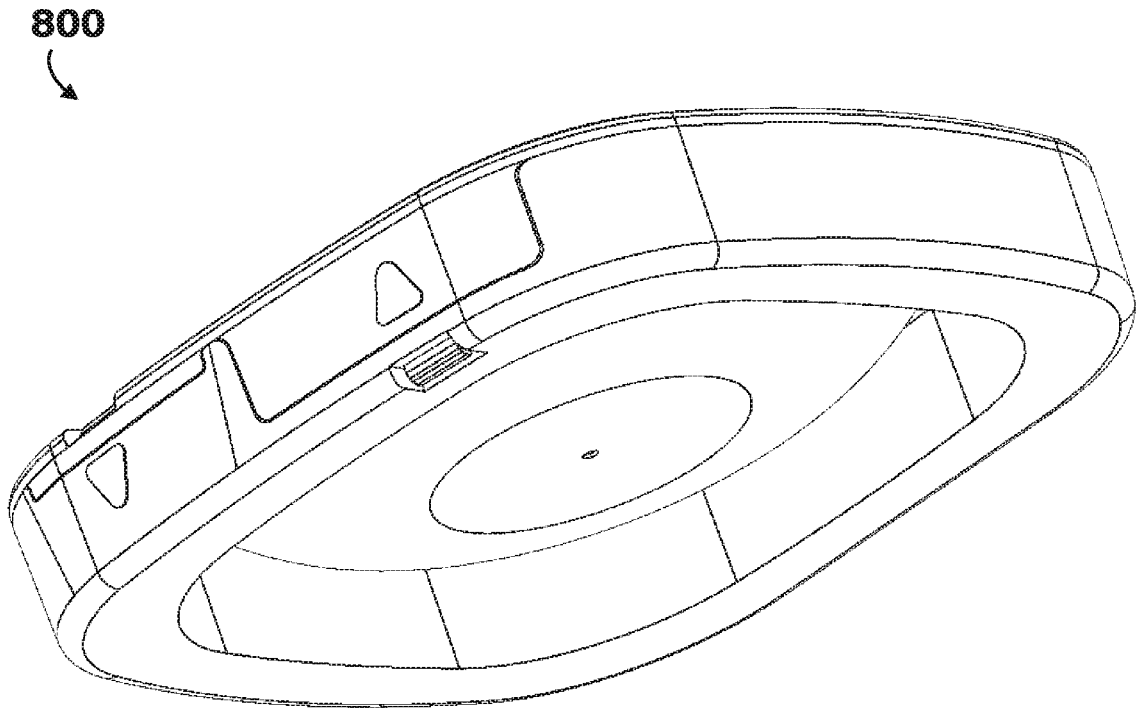
FIG. 45 is a bottom perspective view of a container of an embodiment of the presently disclosed technology, wherein the container is shown in a first or closed configuration.
Figure 46:
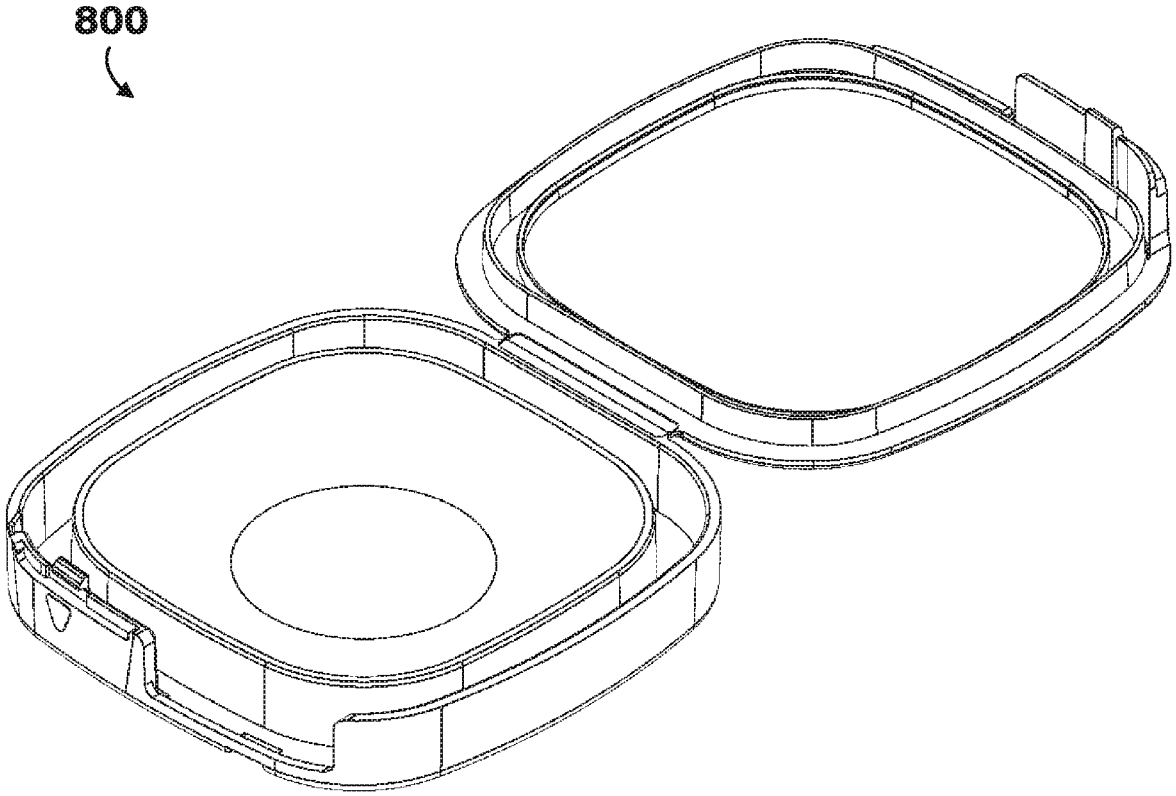
FIG. 46 is a top perspective view of the container of FIG. 45, wherein the container is shown in a second or open configuration.
Figure 47:
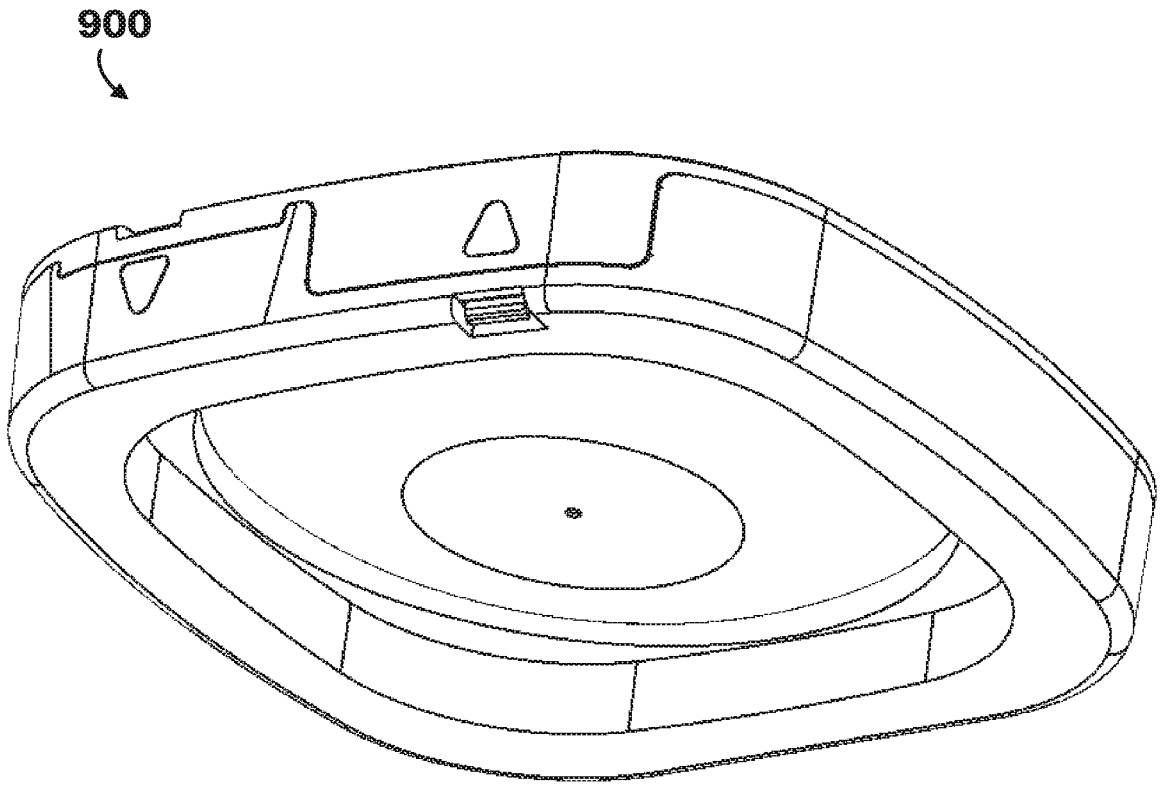
FIG. 47 is a bottom perspective view of a container of an embodiment of the presently disclosed technology, wherein the container is shown in a first or closed configuration.
Figure 48:
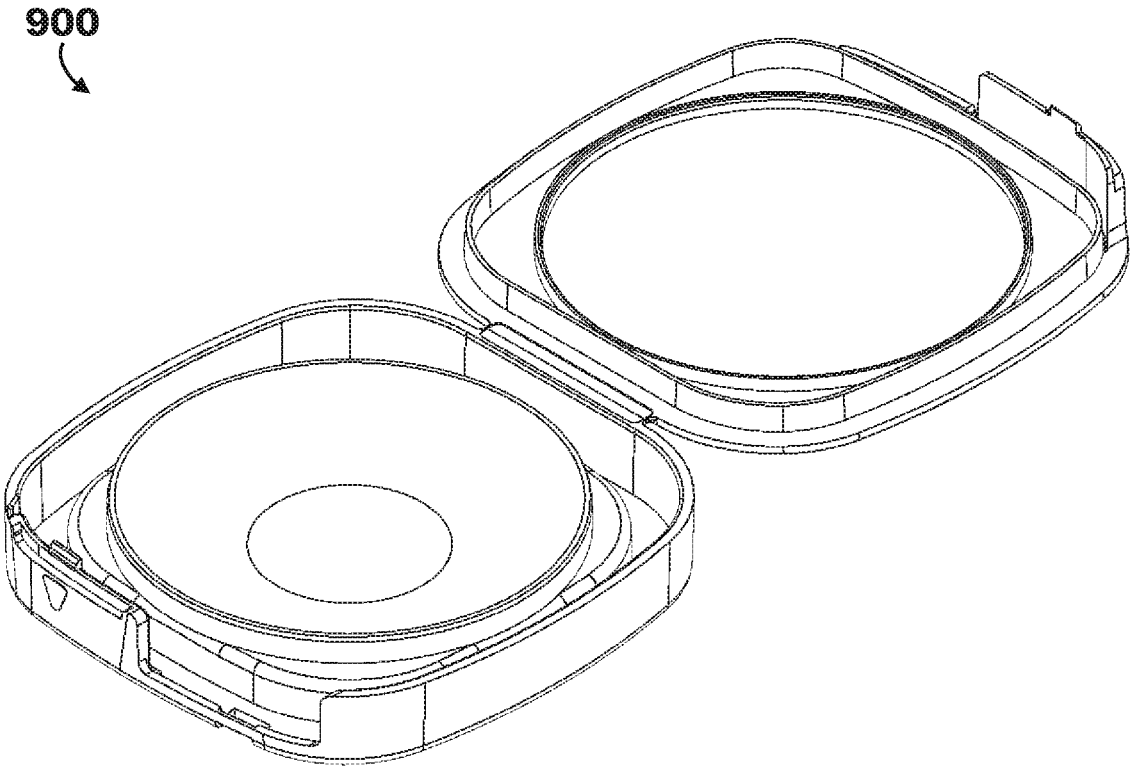
FIG. 48 is a top perspective view of the container of FIG. 47, wherein the container is shown in a second or open configuration.

FIGS. 40-44 show another embodiments of container 700 that includes features that are substantially similar to that of container 600 shown in FIGS. 35-39. FIGS. 45-46 show yet another of container 800 that includes feature that are substantially similar to that of container 600 shown in FIGS. 35-39. FIGS. 47-48 show still a further embodiment of container 900 that includes feature that are substantially similar to that of container 600 shown in FIGS. 35-39. Description of certain similarities between the embodiment of FIGS. 40-44 and the embodiment of FIGS. 35-39 is omitted herein for convenience and brevity only.

The following exemplary embodiments further describe optional aspects of the presently disclosed technology and are part of this Detailed Description. These exemplary embodiments are set forth in a format substantially akin to claims (each with numerical designations followed by a letter), although they are not technically claims of the present application. The following exemplary embodiments refer to each other in dependent relationships as "embodiments" instead of "claims." Any of the below described embodiments can be combined or omitted from any combination, regardless of the explicit dependency recited below.

1A. A container comprising:

a base including a floor portion and an outer wall extending upwardly therefrom; and a lid including a ceiling portion and an outer wall extending downwardly therefrom, the lid being movable with respect to the base between a closed position and an open position, in the closed position the combined lid and base define a cavity configured to enclose product, one of the base and the lid including a latching mechanism extending upwardly away from the floor portion or downwardly away from the ceiling portion, the latching mechanism being pivotable with respect to the base and the lid, at least a portion of the latching mechanism engaging the other one of the base and the lid in the closed position, the latching mechanism being spaced-apart from the other one of the base and the lid in the open position.

2A. The container of any embodiment herein, optionally of embodiment 1A or 1B, wherein the outer wall of the lid includes a grooved region, a distal end of the latching mechanism engaging the grooved region when the lid is in the closed position.

3A. The container of any embodiment herein, optionally of embodiment 2A, wherein the grooved region is opposite a hinge connecting the base to the lid.

4A. The container of any embodiment herein, optionally of embodiment 2A, wherein a tooth extends downwardly from the ceiling portion of the lid on opposing sides of the grooved region, each tooth extending downwardly further then the outer wall of the lid.

5A. The container of any embodiment herein, optionally of embodiment 4A, wherein a proximal end of the latching mechanism is integrally formed with the floor portion of the base.

6A. The container of any embodiment herein, optionally of one of embodiment 4A and 1D, wherein the base includes an inner wall spaced inwardly from the outer wall of the base.

1B. A container comprising:

a base including a floor portion and an outer wall extending upwardly therefrom, a latching mechanism extending upwardly away from the floor portion of the base, the latching mechanism being pivotable with respect to the base; and a lid including a ceiling portion and an outer wall extending downwardly therefrom, the lid being movable with respect to the base between a closed position and an open position, in the closed position the combined lid and base define a cavity configured to enclose product, at least a distal portion of the latching mechanism engaging the lid in the closed position, at least the distal portion of the latching mechanism being spaced-apart from the lid in the open position.

1C. A container for storing products therein, the container comprising:

a container body defining an interior for housing products and an opening leading to the interior;

a lid movable with respect to the container body to move the container between a closed position in which the lid covers the opening and encloses the products therein, and an opened position in which the opening is exposed;

a latching mechanism configured to move between a locked position in which the latching mechanism engages the lid in the closed position, and an unlocked position in which the latching mechanism permits the lid to move into the opened position;

the latching mechanism being movable from the locked position to the unlocked position by a first movement comprising moving a free end of the latching mechanism in a first direction away from one of the container body and the lid.

2C. The container of any embodiment herein, optionally of embodiment 1C, further comprising a hinge attaching the container body to the lid, wherein the latching mechanism is positioned on one side of the container opposite the hinge.

1D. A container comprising:

a base including a floor portion and an outer wall extending upwardly therefrom; and a lid including a ceiling portion and an outer wall extending downwardly therefrom, the lid being movable with respect to the base between a closed position and an open position, in the closed position the combined lid and base define a cavity configured to enclose product, one of the base and the lid including at least one retention member extending upwardly away from the floor portion or downwardly from the ceiling portion, the retention member being pivotable with respect to the base and the lid, at least a portion of the retention member engaging the other one of the base and the lid in the closed position, the retention member being spaced-apart from the other one of the base and the lid in the open position, and the other of the base and the lid including at least one groove extending therethrough, wherein at least a portion of the retention member extending through the at least one groove when the lid is in the closed position.

2D. The container of any embodiment herein, optionally of embodiment 1D, wherein a bottom end of the retention member is integrally formed with the floor portion of the base.

3D. The container of any embodiment herein, optionally of embodiment 1D, wherein the at least one groove is located within a pocket on an interior surface of the outer wall of the lid.

4D. The container of any embodiment herein, optionally of embodiment 1D, wherein the at least one retention member includes at least two retention members, each retention member being located on a different side of the container.

5D. The container of any embodiment herein, optionally of embodiment 4D, wherein a hinge connects the lid to the base, and wherein the hinge is located on a different side of the container than each of the retention members.

6D. The container of any embodiment herein, optionally of any one of embodiment 1D-4D, wherein the retention member is formed in the outer wall of the base.

1E. A container comprising:

a base including a floor portion and an outer wall extending upwardly therefrom; and a lid including a ceiling portion and an outer wall extending downwardly therefrom, the lid being movable with respect to the base between a closed position and an open position, in the closed position the combined lid and base define a cavity configured to enclose product, one of the base and the lid including two securing members extending outwardly from the outer wall thereof, each securing member being movable with respect to the base and the lid, at least a portion of each securing member engaging the other one of the base and the lid in the closed position.

2E. The container of any embodiment herein, optionally of embodiment 1E, wherein the other one of the base and the lid including a projection, each securing member engaging the projection in the closed position.

3E. The container of any embodiment herein, optionally of embodiment 2E, wherein an interior end of each securing member includes a hook portion, and wherein the hook portion engages the projection in the closed position.

4E. The container of any embodiment herein, optionally of embodiment 3E, wherein exterior ends of the two securing members are configured to be moved toward one another, thereby moving the hook portions away from the projection to allow the lid to move to the open position.

5E. The container of any embodiment herein, optionally of embodiment 2E, wherein the two securing members are attached to the lid, the projection is located on the base, and the projection is positioned opposite a hinge that connects the lid to the base.

1F. A container comprising:

a base including a floor portion and a wall extending upwardly therefrom; and a lid including a ceiling portion and a wall extending downwardly therefrom, the lid being movable with respect to the base between a closed position and an open position, in the closed position the combined lid and base define a cavity configured to enclose product, one of the base and the lid including at least one latching mechanism, the latching mechanism being pivotable with respect to the floor portion or the ceiling portion, and the other of the base and the lid including at least one opening extending therethrough, at least a portion of the at least one latching mechanism extending through the at least one opening when the container is in the closed position.

2F. The container of any embodiment herein, optionally of any one of embodiment 1F and 1G, wherein the wall of the base is spaced inwardly from an entire outer periphery of the floor portion.

3F. The container of any embodiment herein, optionally of any one of embodiment 1F and 2F, wherein the lid includes two tabs extending outwardly from the wall thereof, wherein a hinge connects the base to the lid, the hinge being attached to a side of the wall of the lid opposite to a side of the wall including the two tabs.

4F. The container of any embodiment herein, optionally of embodiment 3F, wherein the at least one latching mechanism includes a lip, at least a portion of the lid engaging the lid between the two tabs when the container is in the closed position.

5F. The container of any embodiment herein, optionally of any one of embodiment 1F and 2F, wherein the at least one latching mechanism is positioned between an outer periphery of the floor portion of the base and the wall of the base.

1G. A container comprising:

a base including a floor portion and a wall extending upwardly therefrom; and a lid including a ceiling portion and a wall extending downwardly therefrom, the lid being movable with respect to the base between a closed position and an open position, in the closed position the combined lid and base define a cavity configured to enclose product, one of the base and the lid including at least one retaining member, the at least one retaining member being pivotable with respect to the floor portion or the ceiling portion, the at least one retaining member including a hook portion at a distal or free end thereof, and the other of the base and the lid including at least one deflection member, the at least one deflection member being pivotable with respect to the floor portion or the ceiling portion, the at least one deflection member including a hook portion at a distal or free end thereof, wherein, in the closed position, the hook portion of the at least one retaining member engaging the hook member of the at least one deflection member.

2G. The container of any embodiment herein, optionally of embodiment 1G, wherein the lid includes at least two retaining members extending downwardly from the ceiling portion, and wherein the base includes at least two deflection members extending upwardly from the floor portion thereof.

3G. The container of any embodiment herein, optionally of embodiment 2G, wherein each deflection member is spaced outwardly from the wall of the base.

4G. The container of any embodiment herein, optionally of any one of embodiment 2G or 3G, wherein each retaining member is spaced inwardly from the wall of the lid.

5G. The container of any embodiment herein, optionally of any one of embodiment 2G-4G, wherein each deflection member is located in a cut-out formed in the floor portion of the base.

6G. The container of any embodiment herein, optionally of any one of embodiment 1A-1G, wherein the product is one of pills, tablets, gel-caps, capsules, tobacco-containing substances, nicotine replacement formulations, and *cannabis*-containing substances.

The presently disclosed technology has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the presently disclosed technology that others can, by applying knowledge within the skill of the art, readily modify and/or adapt for various applications such specific embodiments, without undue experimentation, without departing from the general concept of the presently disclosed technology. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the presently disclosed technology should not be limited by any of the above-described exemplary embodiments, but should be defined only in accordance with the following claims and their equivalents.

What is claimed is:

1. A container comprising:

a base including a floor portion and an outer wall extending upwardly therefrom; and a lid including a ceiling portion and an outer wall extending downwardly therefrom, the lid being movable with respect to the base between a closed position and an open position, in the closed position the combined lid and base defining a cavity configured to enclose product, one of the base and the lid including at least one tab extending upwardly away from the floor portion or downwardly away from the ceiling portion, the at least one tab being positioned inwardly of the outer wall of the one of the base and the lid, and the other one of the base and the lid including at least one opening extending therethrough, at least a portion of the at least one tab extending through the at least one opening and laterally outwardly past the outer wall of the other one of the base and the lid to maintain the lid in the closed position, wherein the base further includes an inner wall extending upwardly from the floor portion, the inner wall being positioned inwardly of the outer wall of the base, the at least one tab being positioned outwardly of the inner wall.

2. The container of claim 1, wherein the at least one tab is pivotable inwardly away from the outer wall of the one of the base and the lid so as to pass through the at least one opening to allow the lid to move to the open position, and the lid is pivotable with respect to the base about a hinge, the at least one tab being positioned on an opposite side of the container from the hinge.

3. The container of claim 1, wherein the outer wall of the base extends around a perimeter of the floor portion, and wherein the outer wall of the lid extends around a perimeter of the ceiling portion.

4. The container of claim 1, wherein the at least one opening includes an edge portion extending around a periphery thereof, wherein the at least one tab includes a hook portion at a distal or free end thereof, and wherein the hook portion engages the edge portion when the container is in the closed position, the container comprising a button extending outwardly from the at least one tab in the same direction as the hook portion, the button being positioned below the hook portion, at least a portion of the button extending through an aperture in the outer wall of the one of the base and the lid when the container is in the closed position.

5. A container comprising:

a base including a floor portion and an outer wall extending upwardly therefrom; and a lid including a ceiling portion and an outer wall extending downwardly therefrom, the lid being movable with respect to the base between a closed position and an open position, the lid being pivotable with respect to the base about a hinge, in the closed position the combined lid and base defining a cavity configured to enclose product, one of the base and the lid including at least one tab extending upwardly away from the floor portion or downwardly away from the ceiling portion, the at least one tab being positioned inwardly of the outer wall of the one of the base and the lid, and the other one of the base and the lid including at least one opening extending therethrough, at least a portion of the at least one tab extending through the at least one opening and laterally outwardly past the outer wall of the other one of the base and the lid to maintain the lid in the closed position, wherein the at least one tab includes a first tab and a second tab, the first tab extending upwardly away from the floor portion of the base and the second tab extending downwardly away from the ceiling portion of the lid, and the at least one opening including a first opening and a second opening, the first opening extending through the lid and the second opening extending through the base, wherein the base further includes an inner wall extending upwardly from the floor portion, the inner wall being positioned inwardly of the outer wall of the base.

6. The container of claim 5, wherein the second tab is pivotable inwardly away from the outer wall of the lid so as to pass through the second opening.

7. The container of claim 6, wherein the second tab includes a hook portion at a distal or free end thereof, the second tab further including a button extending radially outwardly therefrom in the same direction as the second hook portion.

8. The container of claim 7, wherein a first aperture extends through the outer wall of the base and a second aperture extends through the outer wall of the lid, at least a portion of the button of the first tab extending through the first aperture when the container is in the closed position, at least a portion of the button of the second tab extending through the second aperture when the container is in the closed position.

9. The container of claim 5, wherein a first aperture extends through the outer wall of the base, at least a portion of the button of the at least one tab extending through the first aperture when the container is in the closed position.

10. A method of opening a container, the container including a base having a floor portion, an outer wall extending upwardly therefrom, and an inner wall extending upwardly from the floor portion that is positioned inwardly of the outer wall of the base, the container including a lid having a ceiling portion and an outer wall extending downwardly therefrom, a first button configured to extend from a first tab outwardly through and past the outer wall of the base, a second button configured to extend from a second tab outwardly through and past the outer wall of the lid, the method comprising:

pressing the first button inwardly toward a center of the container;

pressing the second button inwardly toward the center of the container; and pivoting the lid with respect to the base to expose a cavity configured to contain product.

11. The method of claim 10, wherein pressing the first button inwardly toward the center of the container causes a first hook portion of a first tab to disengage an edge portion of an opening extending through the lid.

12. The method of claim 10, wherein pressing the second button inwardly toward the center of the container causes a second hook portion of a second maintaining tab to disengage an edge portion of an opening extending through the base.

13. The method of claim 10, wherein the lid is pivotable with respect to the base about a hinge, and wherein each of the first and second buttons are configured to be pressed inwardly toward the hinge.

14. The method of claim 10, wherein the first button extends outwardly from the first maintaining tab extending upwardly from the floor portion of the base and the second button extends outwardly from a second maintaining tab extending downwardly from the ceiling portion of the lid.

15. The method of claim 10, wherein each of the first and second buttons are exposed through an aperture on the same side of the container.

16. The method of claim 15, wherein the container includes four sides, a top surface and a bottom surface.

17. A container comprising:

a base including a floor portion and an outer wall extending upwardly therefrom, a first maintaining tab extending upwardly away from the floor portion, the first maintaining tab positioned inwardly of the outer wall of the base portion, an opening extending through the base;

a lid including a ceiling portion and an outer wall extending downwardly therefrom, a second maintaining tab extending downwardly away from the ceiling portion, the second maintaining tab positioned inwardly of the outer wall of the lid, an opening extending through the lid; and a hinge pivotally attaching the lid to the base, wherein the lid is movable with respect to the base between a closed position and an open position, in the closed position the combined lid and base defining a cavity configured to enclose product, at least a portion of the first maintaining tab extending through the opening of the lid and over the outer wall of the base when the lid is in the closed position, at least a portion of the second maintaining tab extending through the opening of the base and under the outer wall of the lid when the lid is in the closed position, wherein the base further includes an inner wall extending upwardly from the floor portion, the inner wall being positioned inwardly of the outer wall of the base.

18. The container of claim 17, wherein each opening includes an edge portion extending around the periphery thereof, each maintaining a tab including a hook portion at a distal end thereof and a button, each hook portion engaging one of the edge portion when the container is in the closed position.

19. The container of claim 17, wherein each outer wall includes one of the apertures extending therethrough, at least a portion of each button extending through one of the apertures when the container is in the closed position.

20. The container of claim 17, wherein each maintaining tab is configured to be pivoted inwardly away from the outer wall of the one of the base and the lid so as to pass through the respective opening to allow the lid to move to the open position.

21. A method of opening a container, the container including a base having a floor portion, an outer wall extending upwardly from the floor portion, and an inner wall extending upwardly from the floor portion of the base and positioned inwardly of the outer wall of the floor portion, and a first tab extending upwardly away from the floor portion and outwardly of the inner wall, the container further including a lid having a ceiling portion, an outer wall extending downwardly from the ceiling portion of the lid, and a second tab extending downwardly away from the ceiling portion of the lid, at least a portion of the first tab being configured to extend laterally outwardly beyond the outer wall of the lid when the container is in a closed position, at least a portion of the second tab being configured to extend laterally outwardly beyond the outer wall of the base when the container is in the closed position, the method comprising:

pressing the first tab inwardly toward a center of the container to disengage the first tab from the ceiling portion of the lid;

pressing the second tab inwardly toward the center of the container to disengage the second tab from the floor portion of the base; and pivoting the lid with respect to the base to expose a cavity configured to contain product.

22. The method of claim 21, wherein the first tab is on a first side of a center line of the container, and the second tab is on an opposing second side of the center line of the container.

23. The method of claim 21, wherein the first tab is positioned inwardly of the outer wall of the base, and wherein the second tab is positioned inwardly of the outer wall of the base.

24. The method of claim 21, wherein the first and second tabs are pressed simultaneously.

25. The method of claim 21, wherein the steps of pressing the first and second tabs inwardly toward the center of the container includes pressing the first and second tabs toward a hinge of the container.

* * * * *